US010758833B2

(12) United States Patent
Hamel et al.

(10) Patent No.: US 10,758,833 B2
(45) Date of Patent: Sep. 1, 2020

(54) TOY CAR LAUNCHER APPARATUS

(71) Applicant: Hasbro, Inc., Pawtucket, RI (US)

(72) Inventors: Daniel Roger Hamel, Ludlow, MA (US); David Michael Nugent, Newport, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 16/105,523

(22) Filed: Aug. 20, 2018

(65) Prior Publication Data

US 2019/0060772 A1 Feb. 28, 2019

Related U.S. Application Data

(60) Provisional application No. 62/551,593, filed on Aug. 29, 2017.

(51) Int. Cl.
*A63H 17/00* (2006.01)

(52) U.S. Cl.
CPC ..... *A63H 17/008* (2013.01)

(58) Field of Classification Search
CPC ..... A63H 17/008
See application file for complete search history.

(56) References Cited

U.S. PATENT DOCUMENTS 3,693,282 A * 9/1972 Adicks ..... A63H 17/008 446/430
3,701,216 A 10/1972 Smith, III et al.
3,895,459 A * 7/1975 Morrison ..... A63F 9/14 446/430
4,267,661 A 5/1981 Hanson
4,373,290 A 2/1983 Goldfarb et al.
4,382,347 A 5/1983 Murakami
4,403,440 A * 9/1983 Wulff ..... A63H 18/026 446/430
4,418,495 A 12/1983 Kennedy et al.
4,472,906 A * 9/1984 Cook ..... A63H 17/008 124/79
4,479,326 A 10/1984 Kennedy et al.
4,483,096 A 11/1984 Gabler et al.
4,642,066 A * 2/1987 Kennedy ..... A63H 17/008 124/26
4,690,654 A * 9/1987 DeLaney ..... A63H 17/008 124/16

(Continued)

*Primary Examiner* — Eugene L Kim
*Assistant Examiner* — Alyssa M Hylinski
(74) *Attorney, Agent, or Firm* — Perry Hoffman

(57) ABSTRACT

Four embodiments or variations of launcher apparatus storing either one toy car, two toy cars, eight toy cars or ten toy cars are disclosed. As a safety feature a flex member is used to block toys or other objects that are not properly configured to deflect the flex member. If the flex member is not deflected and the object inserted will not push an ejector rearward from a relaxed position to a cocked position. When a proper toy is inserted, the ejector moves rearward and stretches a spring that supplies launch energy to the ejector and the toy. The flex member is also designed to allow the ejector to deflect the flex member when the ejector is snapped back from the cocked position to the relaxed position. A safety lock is mounted to the housing for preventing operation of the trigger mechanism when the launcher apparatus is not disposed on a surface.

9 Claims, 24 Drawing Sheets

(56) References Cited

U.S. PATENT DOCUMENTS

| | | | | |
|---|---|---|---|---|
| 4,690,658 | A * | 9/1987 | Crosson | A63H 17/008 124/79 |
| 4,732,569 | A | 3/1988 | Hippely et al. | |
| 4,946,417 | A | 8/1990 | Ishikawa et al. | |
| 4,959,035 | A | 9/1990 | Murasaki | |
| 5,254,030 | A | 10/1993 | Ostendorff et al. | |
| 5,525,085 | A | 6/1996 | Liu | |
| 9,097,484 | B2 * | 8/2015 | Poirier | F41B 7/08 |
| 2008/0166947 | A1 | 7/2008 | Bernstein et al. | |
| 2009/0075556 | A1 | 3/2009 | Sun et al. | |

* cited by examiner

TOY CAR LAUNCHER APPARATUS

PRIORITY CROSS-REFERENCE TO RELATED APPLICATION

This application claims priority pursuant to 35 U.S.C. 119(e) from U.S. Provisional Patent Application, No. 62/551,593 filed on Aug. 29, 2017.

FIELD OF THE INVENTION

The present invention relates to toy launcher apparatus, and more particularly, to a hand held single toy car launcher apparatus, a hand held launcher apparatus for two toy cars and a hand held launcher apparatus for ten toy cars as well as variations.

BACKGROUND OF THE INVENTION

Toy racing cars have been combined with a launching platform or ramp on which the vehicle is latched, the car being released by an unlatching mechanism to run down the ramp onto a playing surface. Miniature toy vehicles with very low friction axles are in play frequently launched or propelled over a track or floor surface by a launching device, with the very small vehicles being used in games and the like. Toy racing cars are known having toy vehicles and miniature racing assemblies where the vehicle is normally latched on an inclined ramp extending from the power launcher, with the released vehicle shooting down the ramp when the vehicle is launched.

Typical prior art toys of this type include sets of racing cars, track, remote control and launch modules. Moreover, providing mechanisms to propel a toy vehicle adds to the enjoyment of playing with a toy vehicle, often allowing the toy vehicle to travel faster and farther than if simply pushed by the child playing with the toy. These toys are popular not only due to the child's basic interest in racing cars, but also due to the action developed by such toys.

The experience is enhanced to the extent that the toy apparatus simulates an actual working mechanism. Thus, toy vehicles that exhibit movement, particularly rapid movement, without manual manipulation are extremely appealing to a child. Additional features include the child being provided with the ability to regulate or control various aspects of a toy vehicle by operating buttons, switches, levers, handles, and the like.

There is a need for a toy apparatus that embodies each of these features that children find attractive in hand held single toy car launcher apparatus, hand held launcher apparatus for combined toy cars and a hand held launcher apparatus for multiple toy cars as well as variations.

Earlier prior art patents include U.S. Pat. Nos. 3,693,282; 4,267,661; 4,382,347; 4,479,326; 4,642,066. U.S. Pat. No. 3,693,282, issued to Adicks in 1972 and entitled "Toy Vehicle Launching Device With Safety Mechanism" purports to disclose a hand held toy vehicle launching device with a safety mechanism that includes a spring driven piston 16 and a safety device 30 that includes legs 32 and a cross bar 31 that is pushed upwards when the devise is placed on a surface. A release button 37 is positioned on a spring 46 and the spring is seated on the cross bar such that the button cannot be sufficiently depressed unless the cross bar is raised to compress the spring 46. U.S. Pat. No. 4,267,661 issued to Hanson in 1981 and entitled "Multiple Vehicle Launcher" purports to disclose a hand held multiple toy vehicle launching device using rubber bands for stored energy developed when a car is loaded against the rubber band. Each vehicle includes a catch member 42 that is engaged by a latch member 36. When the trigger 48 is pulled the latch member is bent out of the way and the vehicle launches. Although no safety mechanism is disclosed, the patent states that means may be included to prevent a launch unless the bottom portion 56 is placed on a surface.

U.S. Pat. No. 4,382,347 issued in 1983 to Murakami and entitled "Toy Tractor Assembly" purports to disclose a toy vehicle assembly that transforms itself and launches a small wheeled vehicle 60 by using a spring biased plunger 62. Another early patent, U.S. Pat. No. 4,479,326 entitled "Sparking Toy Vehicle And Launcher" issued to Kennedy and others in 1984 purports to disclose a toy launching devise that includes a power trigger 27 to power up a toy car flywheel 33 and an unlatching mechanism 26 which lifts the back end of the toy car to cause launch.

A newer patent U.S. Pat. No. 4,642,066 issued to Kennedy and others in 1987 and entitled "Toy Vehicle Launcher and Sound Generator" purports to disclose a toy vehicle launcher capable of launching two vehicles at the same time or launching them individually at different times. The launcher uses two spring-operated pistons and has a hexagonal magazine housing for up to twelve toy cars. U.S. Pat. No. 4,373,290 entitled "Wheeled Turbine-Powered Toy Vehicle and Launcher Apparatus" issued to Goldfarb and Everitt in 1983 purports to disclose a toy car launcher apparatus including a pusher 32 movable in a longitudinal slot 74 that is activated by a spring or rubber band 70. The pusher has an L-shaped profile and is cocked by inserting a toy car. A manually operated latch 35 acts to release the pusher and toy car.

SUMMARY OF THE INVENTION

Briefly summarized, the toy launcher apparatus includes a housing for storing a toy to be launched, an ejector mounted to the housing, the ejector being movable from a relaxed position to a cocked position by insertion of the toy to be launched into the housing, and the ejector being movable from the cocked position to the relaxed position in response to launch of the inserted toy, an extendible element mounted to the housing and to the ejector for providing energy to the ejector to launch the toy, a flex member mounted to the housing, the flex member enabled to move from a first position where the flex member prevents movement of the ejector from the relaxed position to the cocked position, to a second position where the flex member is deflected by the inserted toy to enable the ejector to move to the cocked position, and the flex member being able to deflect in response to the ejector moving from the cocked position to the relaxed position, and a trigger mechanism mounted to the housing to enable the resilient element to transfer the launch energy to the ejector.

The present invention also includes a method for making a toy launcher apparatus, the steps of the method including forming a housing having an opening for storing a properly configured toy to be launched, mounting an ejector to the housing, the ejector being movable from a relaxed position to a cocked position by an inserted properly configured toy, mounting an extendible element to the housing and to the ejector, mounting a flex member to the housing to prevent the ejector moving from the relaxed position to the cocked position, to deflect in response to engagement with the properly configured toy, and to deflect in response to engagement with the ejector when the ejector is moving from the cocked position to the relaxed position by the extendible element, mounting a trigger mechanism to the housing for releasing the ejector from the cocked position, and mounting a safety lock to the housing for preventing operation of the trigger mechanism when the launcher apparatus is not disposed on a surface.

The invention here, described below in connection with the illustrated embodiments, offers a combination that has good play value. The features and advantages of the present invention will be explained in, or become apparent from, the following summary and description of the preferred embodiments considered together with the accompanying drawings.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
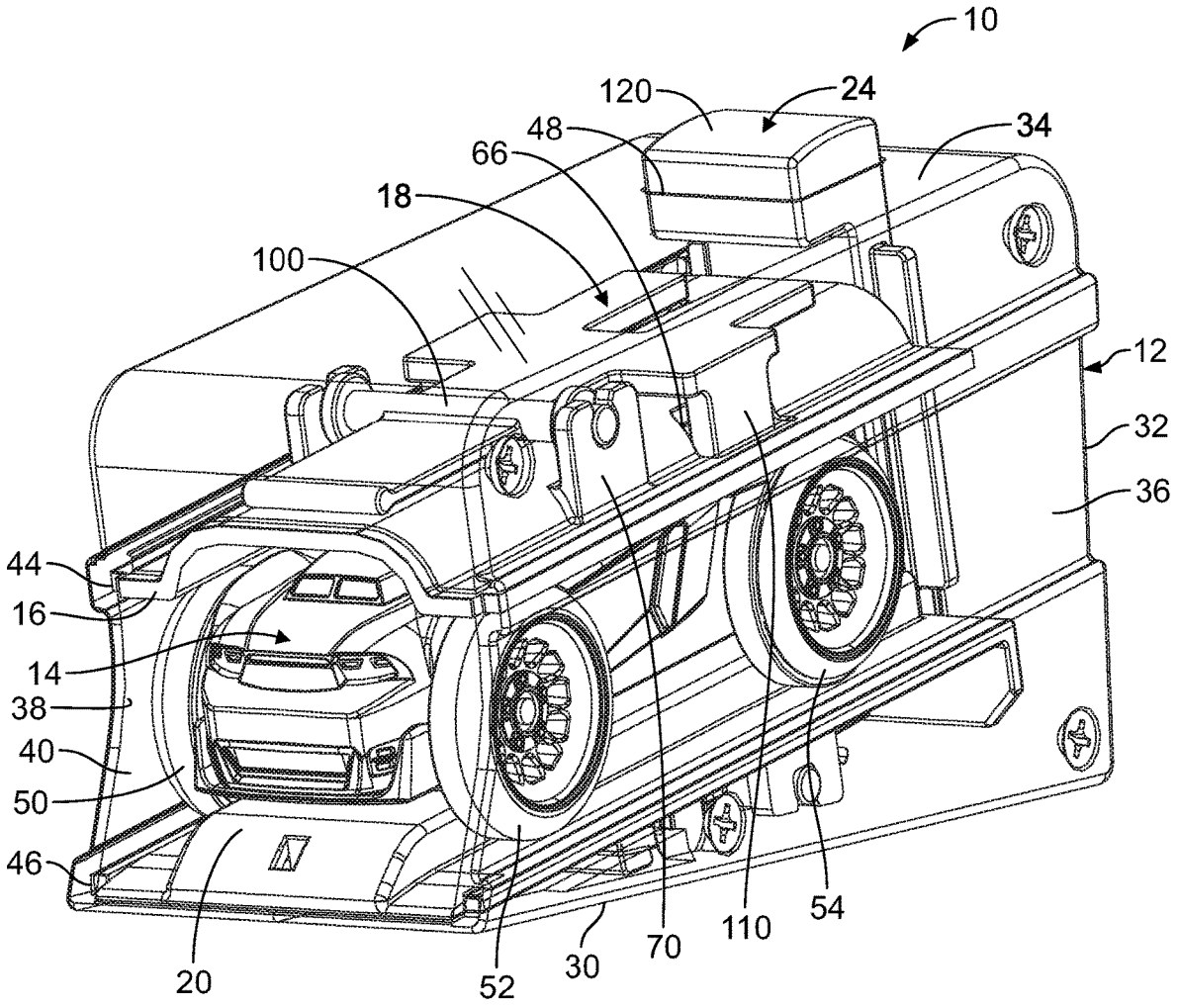
FIG. 1 is a front three-quarter isometric view of a preferred embodiment of the present invention in the form of a single toy car launcher apparatus.
Figure 2:
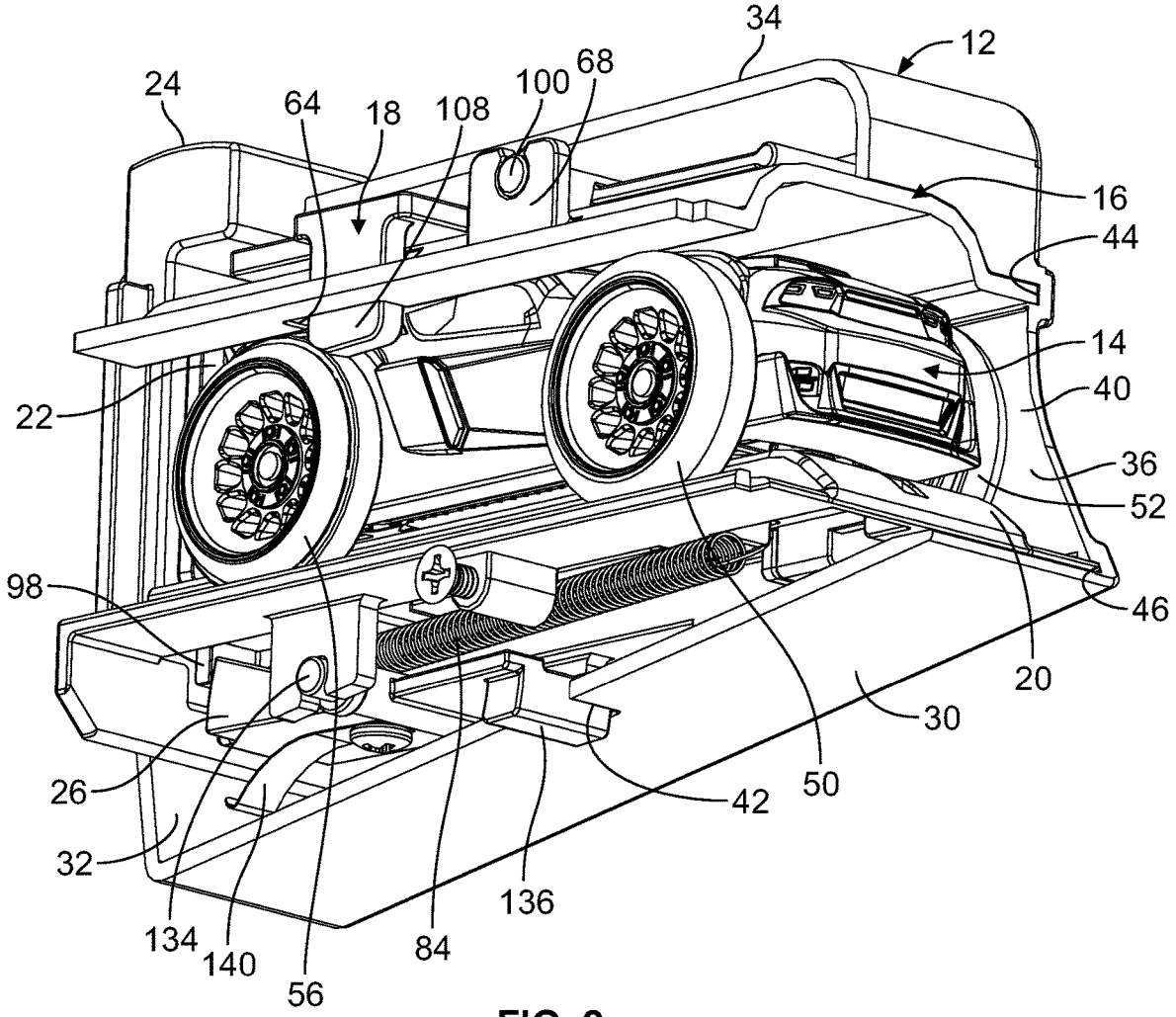
FIG. 2 is an upward looking isometric view of the car launcher apparatus shown in FIG. 1, with half of a housing removed.
Figure 3:
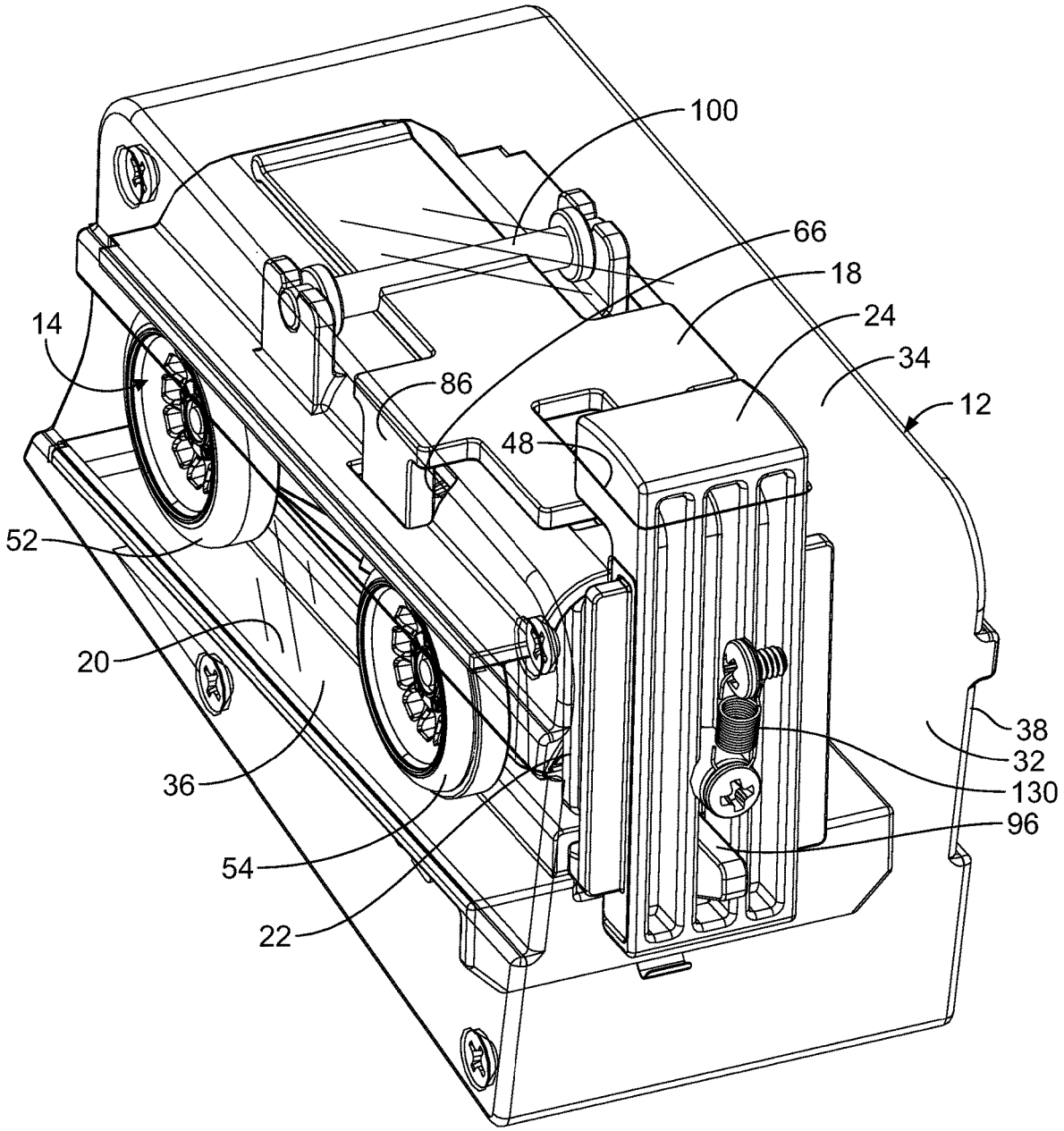
FIG. 3 is a rear three-quarter isometric view of the car launcher apparatus shown in FIGS. 1 and 2.
Figure 11:
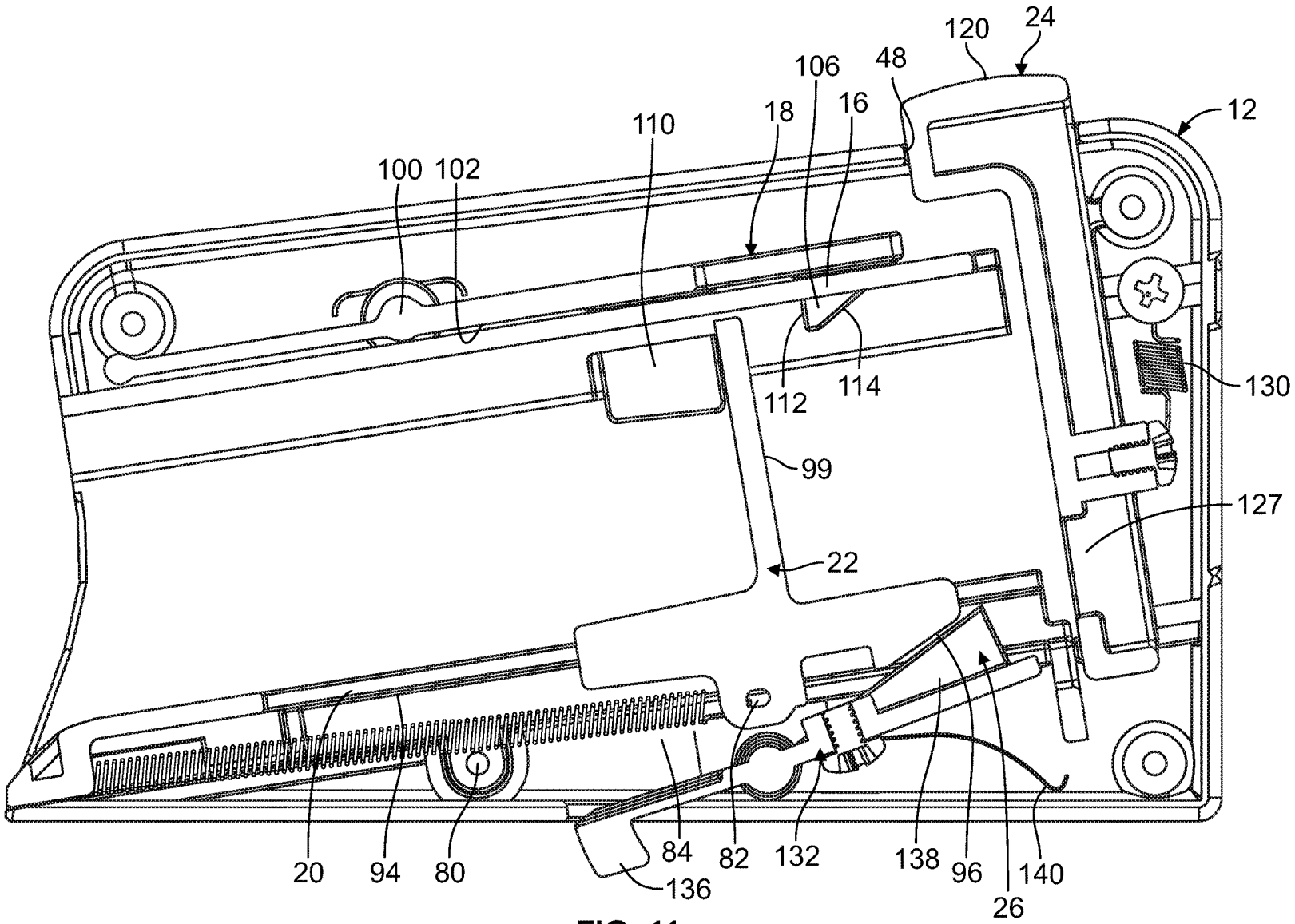
FIG. 11 is a cross-sectional elevation view of the toy car launcher apparatus shown in FIGS. 1-3, in a relaxed configuration with the car removed.
Figure 12:
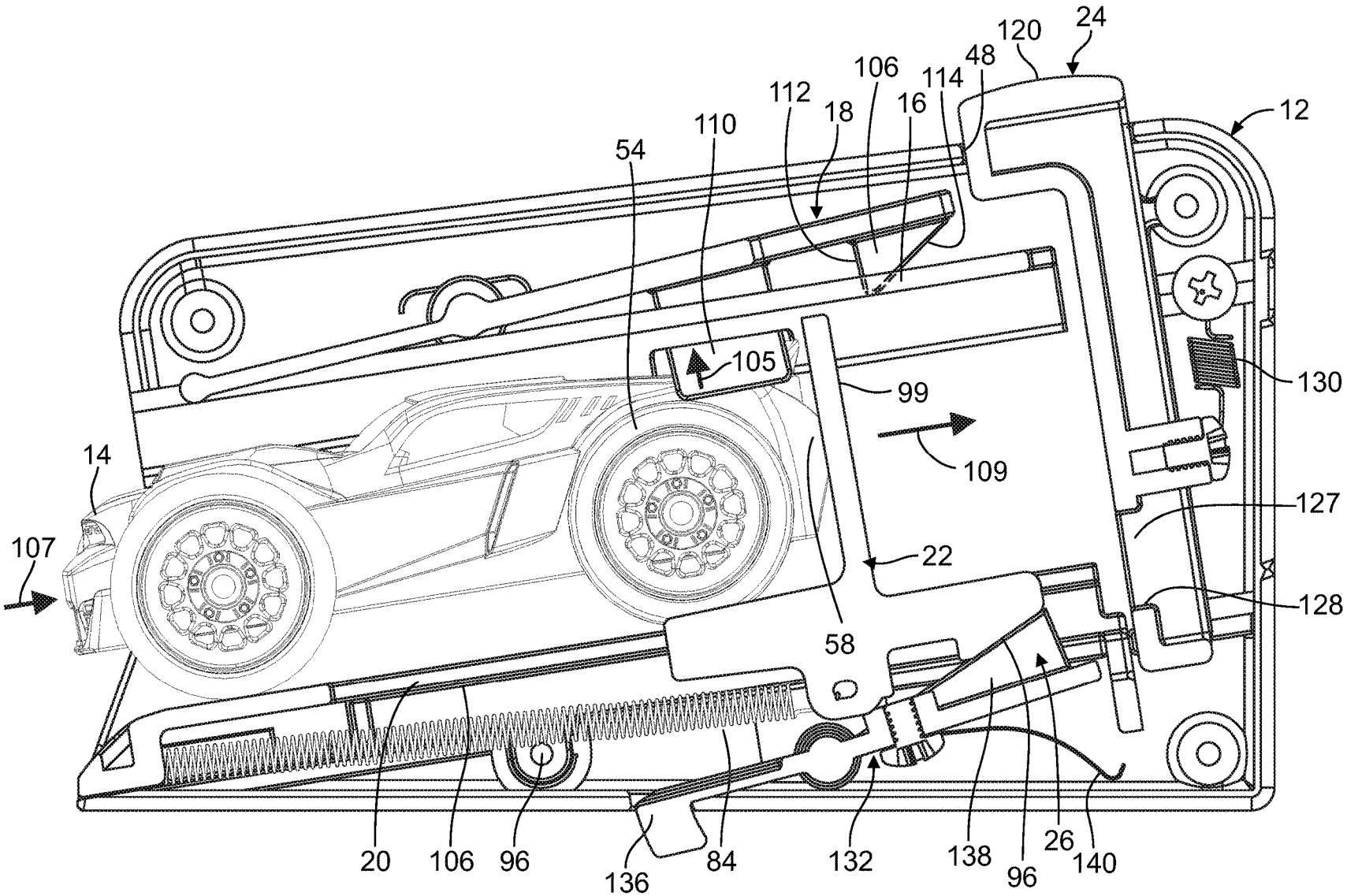
FIG. 12 is a cross-sectional elevation view of the car launcher apparatus shown in FIG. 11, after the car has begun loading.
Figure 13:
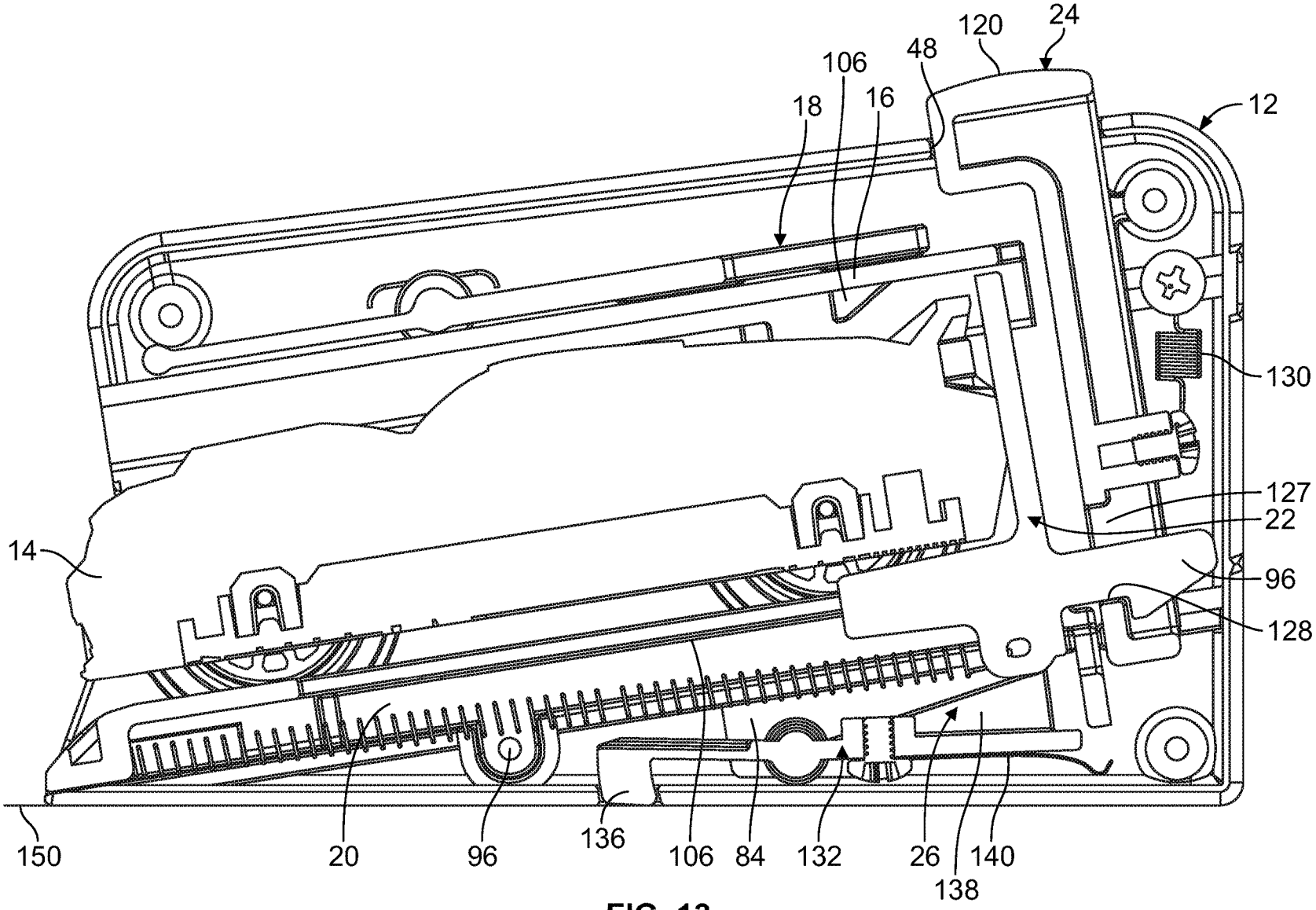
FIG. 13 is a cross-sectional elevation view of the car launcher apparatus shown in FIGS. 11 and 12 in a fully cocked configuration.
Figure 14:
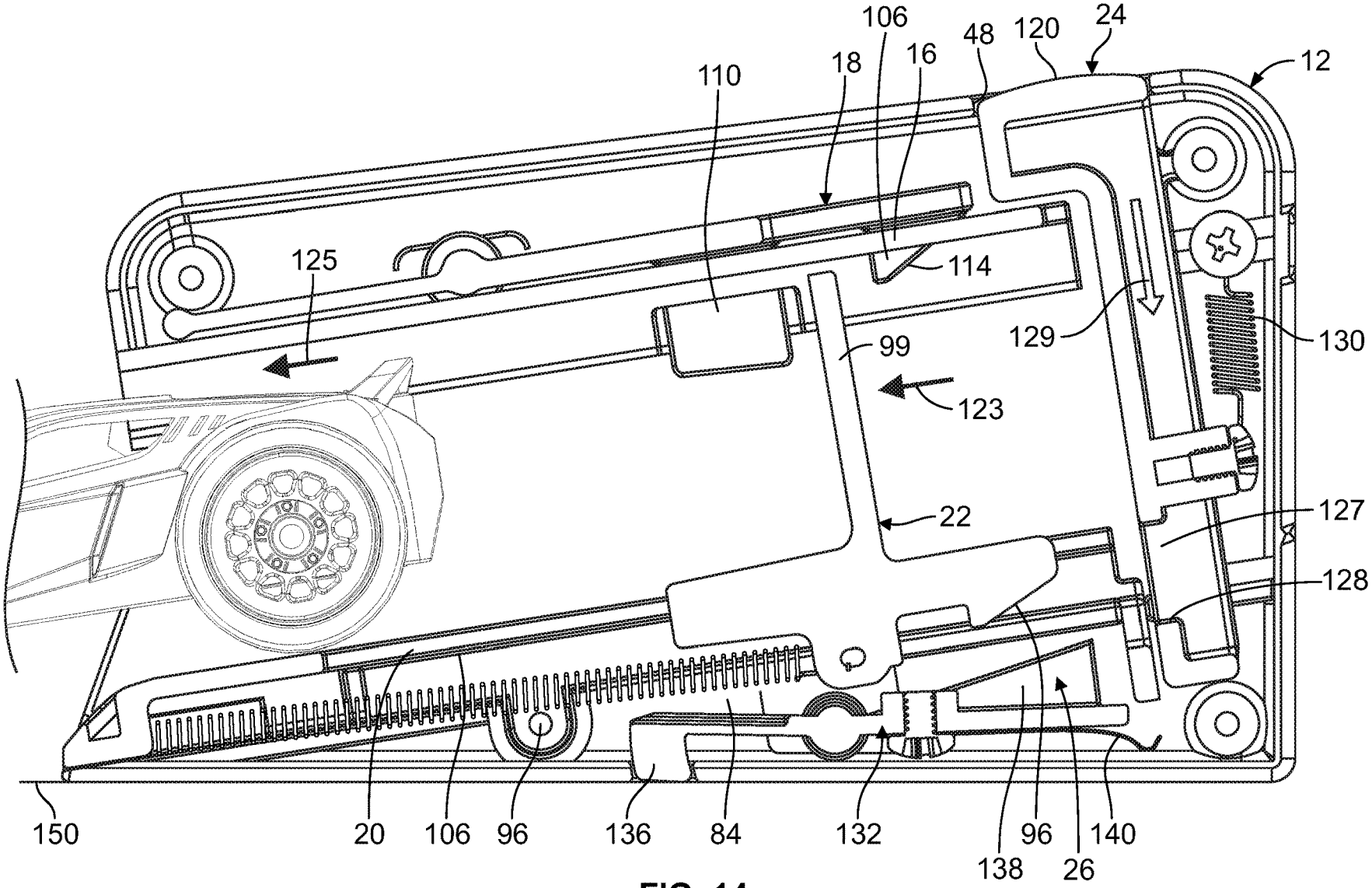
FIG. 14 is a cross-sectional elevation view of the car launcher apparatus shown in FIGS. 11-13 after a trigger mechanism has been actuated and the toy car has been launched.

Referring to FIGS. 1-3, there is illustrated an embodiment of the present invention in the form of a hand held toy launcher apparatus 10 including a chamber housing 12 for storing a toy to be launched, which the toy here is in the form of a car 14. Mounted to the chamber housing 12 is a launcher mechanism including an upper base 16 to which may be mounted a structural member 18 that is able to deflect or flex when engaged by the toy car 14 as it is inserted or loaded into the chamber housing 12 by a user or an operator of the apparatus. The launcher mechanism also includes a lower base 20 mounted to the chamber housing, and mounted to the lower base 20 is an ejector 22 of the toy car that is movable between a relaxed or unbiased position as shown in FIG. 11, through an intermediate position when the toy car is being inserted as shown in FIG. 12, and a fully cocked position as shown in FIG. 13. A trigger mechanism 24 and a safety latch 26 are also mounted to the chamber housing 12 to release the ejector as shown in FIG. 14 during which the ejector returns to the relaxed position and in the process of return deflects the structural or flex member 18.

The chamber housing 12 includes a planar bottom wall 30, and may have a slanted rear wall 32, a sloping top wall 34, two sidewalls 36, 38 and an open front 40. The bottom wall 30 includes a small opening 42 to accommodate the safety latch 26. The sidewalls 36, 38 include upper and lower grooves 44, 46 for mounting the upper and lower bases 16, 20, respectively, and the top wall 34 includes a rearward opening 48 for the trigger mechanism 24. The sloping top wall 34 may have an angle of about nine degrees relative to a horizontal reference such as the bottom wall 30. The housing may be generally transparent as shown in FIGS. 1 and 3.

Figure 4:
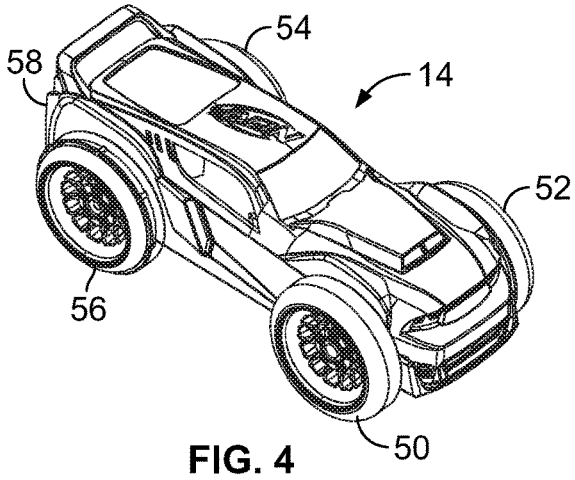
FIG. 4 is an isometric view of a toy car shown in FIGS. 1-3.

The toy car 14, FIG. 4, may be configured as a racer with oversize wheels 50, 52, 54, 56. The oversize rear wheels 54, 56 are provided to engage portions of the flex member 18 so as to override a safety feature that prevents objects of non-conforming shapes from being able to cock the toy launcher apparatus. A rear portion 58 of the toy car 14 is loaded first into the car chamber through the open front 40 of the chamber housing and pushed rearward.

Figure 5:
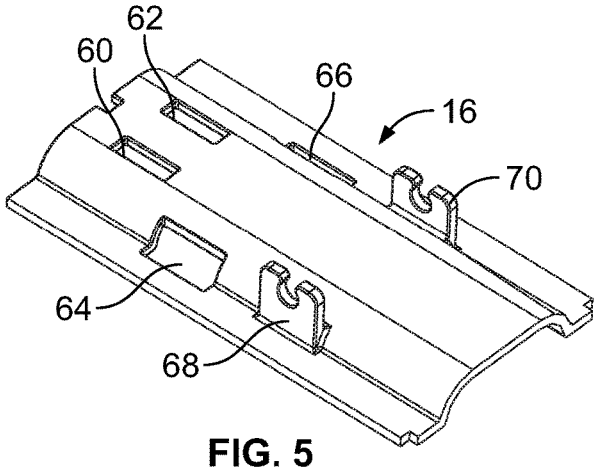
FIG. 5 is an isometric view of an upper base of the car launcher apparatus shown in FIGS. 1-3.

The upper base 16, FIG. 5, is mounted into the upper grooves 44 in the sidewalls 36, 38 of the chamber housing 12 and is fixed in the housing to form a ceiling for the car chamber. The upper base 16 includes two closely spaced, rearward located slots 60, 62, two, more widely spaced openings 64, 66 forward of the rearward slots 60, 62, and two upstanding flanges 68, 70 for mounting the flex member 18.

Figure 6:
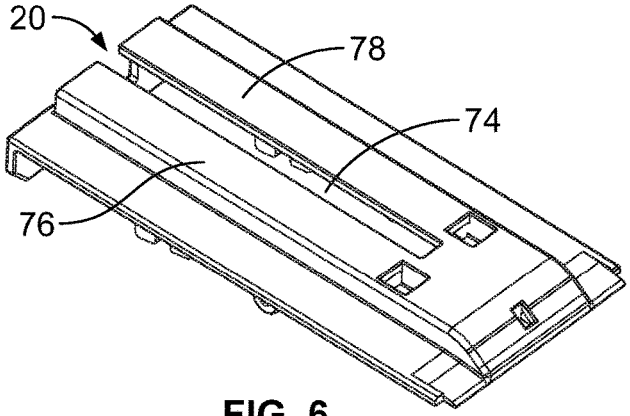
FIG. 6 is an isometric view of a lower base of the car launcher apparatus shown in FIGS. 1-3.

The lower base 20, FIG. 6, is positioned into the lower grooves 46 formed in the chamber housing sidewalls 36, 38. The lower base 20 is fixed in the housing and forms a floor of the car chamber. The lower base 20 may include a central slot 74 and two guides 76, 78 for supporting the ejector 22 as the ejector slides along the central slot 74 between the ejector's relaxed and cocked positions. A front launch spring connector 80, FIG. 11, is mounted to the lower base 20 and a rear launch spring connector 82 is mounted to the bottom of the ejector 22. An extendible element which may taken the form of a launch spring 84 is mounted to the front connector 80 of the lower base and to the rear connector 82 of the ejector 22 and creates the energy or force to launch the toy car 14 after the launch spring 84 is extended. The lower base 20 may be mounted at an oblique angle or at a slant as shown in FIG. 11.

Figure 7:
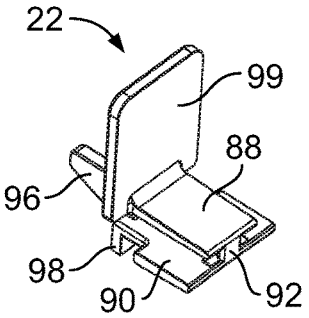
FIG. 7 is an isometric view of an ejector of the car launcher apparatus shown in FIGS. 1-3.

The ejector 22, FIG. 7, may be generally L-shaped in profile with upper and lower flange portions 88, 90 and a vertical connecting cross member 92. The ejector 22 is mounted to move along the central slot 74 of the lower base 20 with the cross member 92 in the slot and the upper flange 88 riding along the guides 76, 78 of the lower base 20 and the lower flange 90 being guided by a bottom surface 94, FIG. 11, of the lower base 20. The lower flange 90 is guided by a bottom surface 94, FIG. 11, of the lower base 20. Located toward the rear of the ejector 22 are a hook 96 and a tail 98, the hook 96 extending rearward to engage the trigger mechanism 24, as shown in FIG. 13, and the tail 98, FIGS. 2 and 7, extending downward to engage or abut the safety latch 26. Extending upward from the tail 98 is a paddle 99 for making contact with the rear 58 of the toy car 14, as shown in FIG. 12, as the user inserts and pushes the toy car to move the ejector from its relaxed position to its cocked position.

Figure 8:
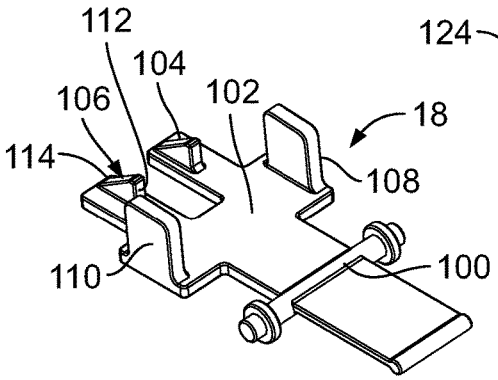
FIG. 8 is an isometric view of an underside of a flex member of the car launcher apparatus shown in FIGS. 1-3.

An important safety feature of the launcher apparatus 10 is that the apparatus is restricted to launch objects that have a proper configuration or shape such as the toy car 14. Objects that have non-conforming configurations will not be allowed to launch. The flex member 18, FIG. 8, is the structure that serves the purpose of preventing objects having non-conforming configurations from being inserted or loaded into the launcher apparatus. The flex member 18 is mounted to the flanges 68, 70, FIG. 5, of the upper base 16 that allow the flex member to bend or deflect at a pivot axis 72 when the flex member is selectively engaged by the rear wheels 54, 56 of a toy car as the car is pushed into the chamber housing by the user.

The structural or flex member 18 has a bottom surface 102, FIGS. 8 and 11, which includes a pair of depending obstructions 104, 106 and laterally disposed depending tabs or protrusions 108, 110. Each blocking member 104, 106 includes an abutment surface and a sloping surface, such as the abutment surface 112, FIG. 11, and the sloping surface 114. The obstructions 104. 106 extend through the rearward slots 60, 62 of the upper base such that the abutment surfaces 112 extend into the rearward path of the ejector and will prevent the ejector 22 from moving rearward beyond the obstructions 104, 106, as is apparent from FIG. 11. FIG. 11 shows that the paddle 99 of the ejector will engage the abutment surfaces 112 and be stopped if nothing more occurs. The sloping surfaces 114 will cause the paddle 99 of the ejector 22 to easily deflect or lift the flex member 18 as the ejector snaps back to the relaxed position during launch, as is apparent from FIG. 14.

The lateral tabs 108, 110 are positioned through the openings 64, 66 of the upper base forward of the obstructions 104, 106 and in the path of the rear wheels 54, 56 of the toy car 14. When the toy is the car 14, the oversized the rear wheels 54, 56 and the lateral tabs 108, 110 are configured to engage and cause the flex member 18 to deflect or bend upward as symbolized by an arrow 105, FIG. 12, as the car is pushed into the housing as shown by arrows 107, 109. The upward deflection of the flex member moves the obstructions 104, 106 away from the rearward path of the ejector as the ejector is moved to the cocking position shown in FIG. 13. In this process the toy car 14 moves the ejector 22 from a relaxed position shown in FIG. 11, to an intermediate position shown in FIG. 12, and finally to the cocked position shown in FIG. 13, where the extended launch spring 84 is prepared to transfer the energy or launching force from itself to the ejector.

Should an attempt be made to insert an object that is not configured to conform to the geometry of the flex member, the lateral tabs 108, 106 will not be engaged and the obstructions 104, 106 will not be moved upward and out of the way. Because the lateral tabs 108, 110 are not engaged, the obstructions 104, 106 will remain in place and block or stop the ejector 22 from reaching the cocked position.

Figure 9:
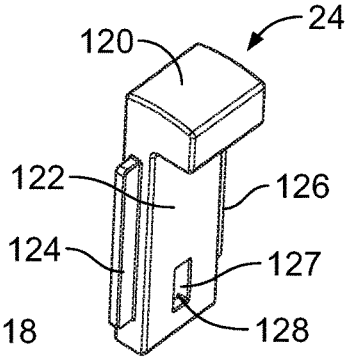
FIG. 9 is an isometric view of a trigger mechanism of the car launcher apparatus shown in FIGS. 1-3.

The trigger mechanism 24, FIG. 9, may include three integral parts, an activation pad 120 at the top, a descending panel 122 with a pair of guide arms 124, 126, and an opening 127 with a lower lip 128 in the lower portion of the panel 122 for receiving the hook 96 of the ejector 22. The activation pad 120 extends through the rear opening 48, FIGS. 1, 3, 11 and 12, of the top wall 34 of the housing 12, and is movable generally in a down and up direction as indicated by an arrow 129, FIG. 14, such that when the user depresses the pad 120, the opening 127 and the lower lip 128 in the lower part of the panel 122 move below the level of the hook 96 of the ejector 22 allowing the ejector to be released to launch the car 14 as indicated by arrows 123, 125 (provided that the safety latch 26 has been pivoted out of the way as will be explained below). Parallel arms (not shown) extend from the housing to embrace the guide arms 124, 126 of the trigger mechanism 24 to maintain stability of the trigger mechanism during operation. A return spring 130, FIG. 11, biases the trigger mechanism upwards once pressure is removed from the pad 120.

Figure 10:
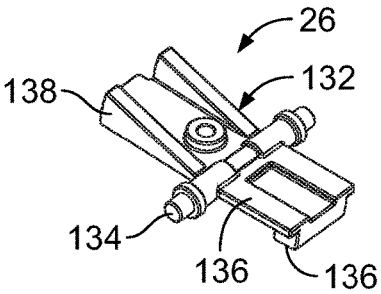
FIG. 10 is an isometric view of a safety latch of the car launcher apparatus shown in FIGS. 1-3.

The toy launcher apparatus 10 also includes the safety latch 26, FIG. 10, in the form of an arm 132 pivotally mounted around a middle portion 134. A lower end 136 of the pivotal arm 132 extends through the opening 42, FIG. 2, in the bottom wall 30 of the housing 12, and the upper end 138 of the arm 132 acts as a latch for abutting the tail 98 of the ejector 22. A spring 140, FIG. 11, is mounted beneath the upper end 138 of the safety latch 26 so as to bias the upper end 138 to engage the ejector 22 when the ejector is in its cocked position. The safety latch 26 ensures that a launch of an inserted toy car does not occur when the launcher apparatus is not disposed firmly on a surface 150, FIG. 13, such as a table or floor.

When the housing is pressed down on the surface, the lower end 136 of the arm 132 is pivoted upward and the upper end 138 of the arm is pivoted downward resulting in the tail 96 of the ejector 22 being released. After the safety latch 26 disengages the ejector, the user may depress the pad 120 of the trigger mechanism 24 as depicted by an arrow 129, FIG. 14, to fully release the ejector 22, the launch spring 84 and the toy car 14, thereby allowing the toy car to be launched. However, when the launcher apparatus 10 is held in a user's hand the spring 140 biases the upper end 138 of the arm 132 into abutment with the tail 96 of the ejector 22 (when the ejector is cocked), and the safety latch 26 continues to engage the tail 96 even when the pad 120 of the trigger mechanism is 24 depressed. The safety latch 26 acts to prevent an inadvertent release of the cocked ejector and the toy car.

In the alternative, the housing need not be transparent, any color may be used for the housing material and/or suitable decals may cover the housing. Also, the walls may not be slanted but may be perpendicular to each other. Or, the upper wall of the housing may not be slanted or the slant may be at a different angle or even angled upward. Toys other than a car may be used with the launcher apparatus provide the toy is properly configured to operate the flex member. Any vehicle may be used that functions to roll or slide along a surface although a flying toy may also be used. The slant of the lower base may be adjusted to an upward angle to handle the flying toy, such as a toy rocket, an airplane or an action figure. Instead of the launch spring, a rubber band or a piston and cylinder may be used to power the toy car launch.

In operation of the launcher apparatus 10, the user pushes a toy car into the housing, back end first as shown in FIG. 12, using the palm of the user's hand. The rear of the toy car presses against the ejector, which is in a relaxed position and pushes the ejector rearward causing the launch spring to be extended. When the hook of the ejector passes through the opening 127 in the trigger mechanism the ejector is restrained and is in a cocked position as shown in FIG. 13, where there is an abutment of the hook 96 against the lower lip 128. During rearward movement of the toy car, the rear wheels of the toy car contact the lateral tabs of the flex member causing the flex member to deflect upward such that the obstructions are moved out of the path of the moving ejector as shown in FIG. 12. FIG. 13 depicts the apparatus on a surface such that the safety latch has rotated and no longer abuts the ejector. The user may then depress the trigger pad causing the hook to disengage from the lower lip and allow the ejector to snap back to the relaxed position and impart launch energy to the toy car as depicted in FIG. 14.

The term 'relaxed position' is used here to mean that the launch spring 84 is at its minimum length for operation of the apparatus even though the spring may be in a slightly extended condition. The term 'cocked position' is used here to mean that the launch spring is at its maximum length for operation of the apparatus even when the launch spring may be able to extend further.

Figure 15:
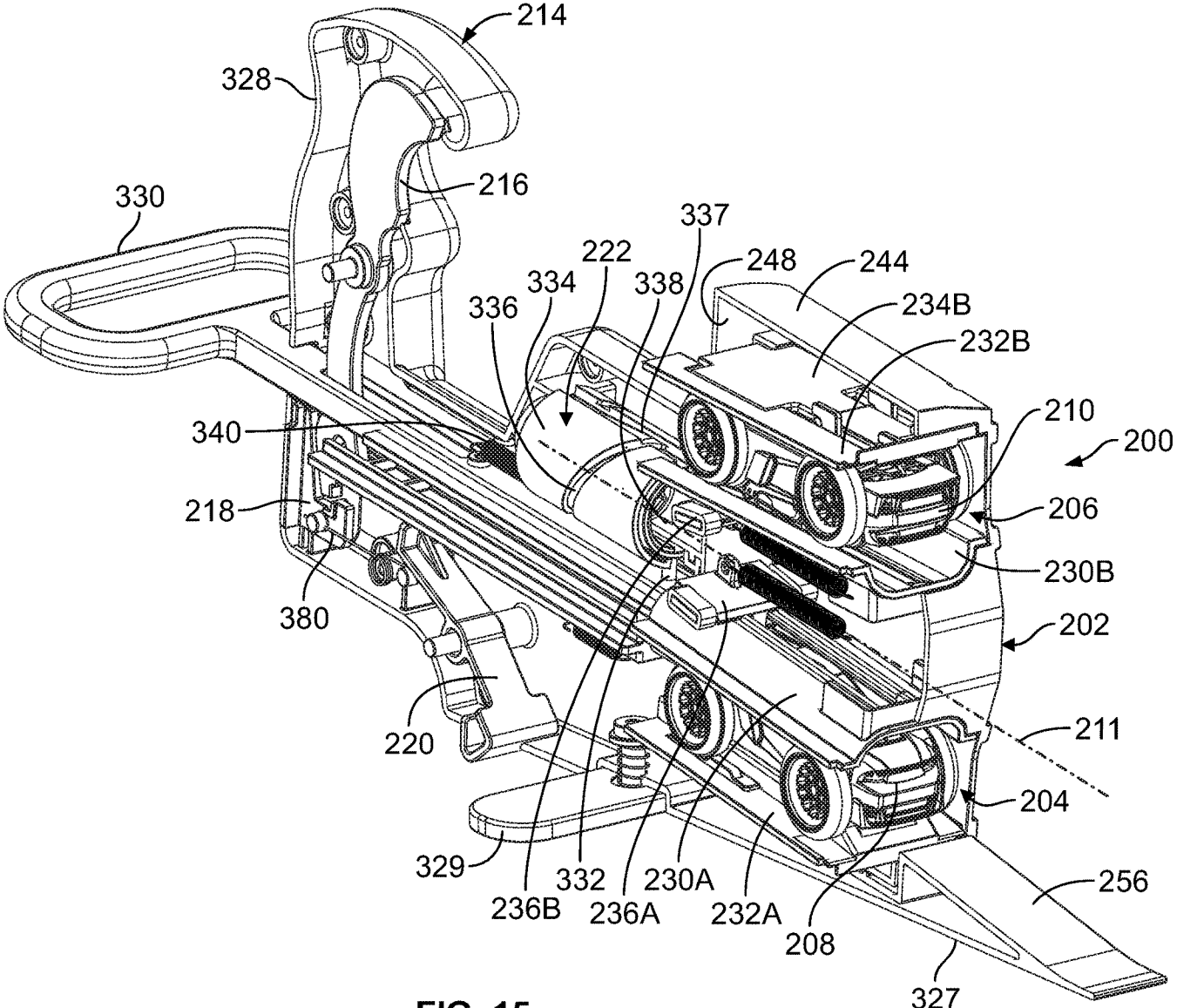
FIG. 15 is a front three-quarter isometric view of a preferred embodiment of the present invention in the form of a toy car launcher apparatus for two toy cars with half of chamber and support housings removed.
Figure 16:
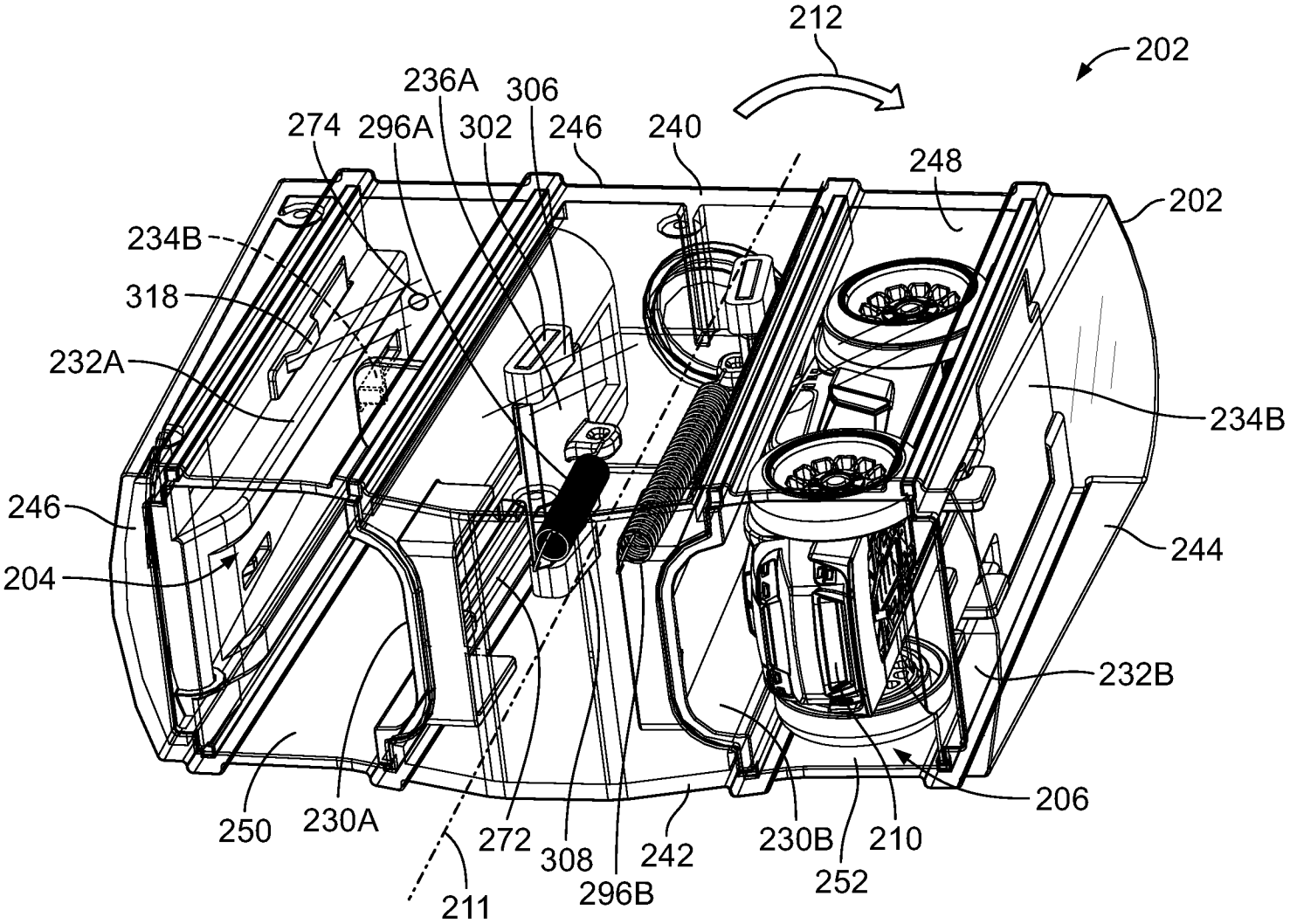
FIG. 16 is an isometric view of the chamber housing of the car launcher apparatus shown in FIG. 15, half way through a rotation after launch of one of the two toy cars.

A variation of the inventive toy launcher apparatus is shown in FIGS. 15-31, where a two car, hand held toy launcher apparatus 200 is illustrated. The launcher apparatus 200 includes a rotational or flip chamber housing 202 designed to have duel toy or car chambers 204, 206 to store two toy cars 208, 210 and enable them to be launched in quick succession by the launcher apparatus 200. The ability to accomplish two quick launches is achieved by flipping or rotating the chamber housing 202 through 180° along an axis 211, FIGS. 15 and 16, as depicted by an arrow 212 in FIG. 16, where the chamber housing 202 is shown about half way through a rotation. The car chamber 204 on the left of FIG. 16 is absent a toy car because the car has been launched when the car chamber was in the position shown in FIG. 15. The car chamber 206 on the right still has a loaded toy car and is in the process of rotating into the launch position, where the car chamber 206 will occupy the lower location previously occupied by the car chamber 204.

The launcher apparatus 200 also includes a support housing 214 for mounting the rotational chamber housing 202, a trigger mechanism 216, a trigger lock member 218, a safety latch 220 and a rotational mechanism 222. Each of the car chambers 204, 206 in the chamber housing 202, like with the single, toy car launcher apparatus 10, includes an upper base 230, a lower base 232, a flex member 234 and an ejector 236. (To distinguish between the two car chambers 204 and 206 in the chamber housing, elements common to both are designated with the same number and a letter "A" or a letter "B". The numbers with an "A" relate to elements in the car chamber 204 and the numbers with a "B" relate to elements in the car chamber 206.)

Figure 17:
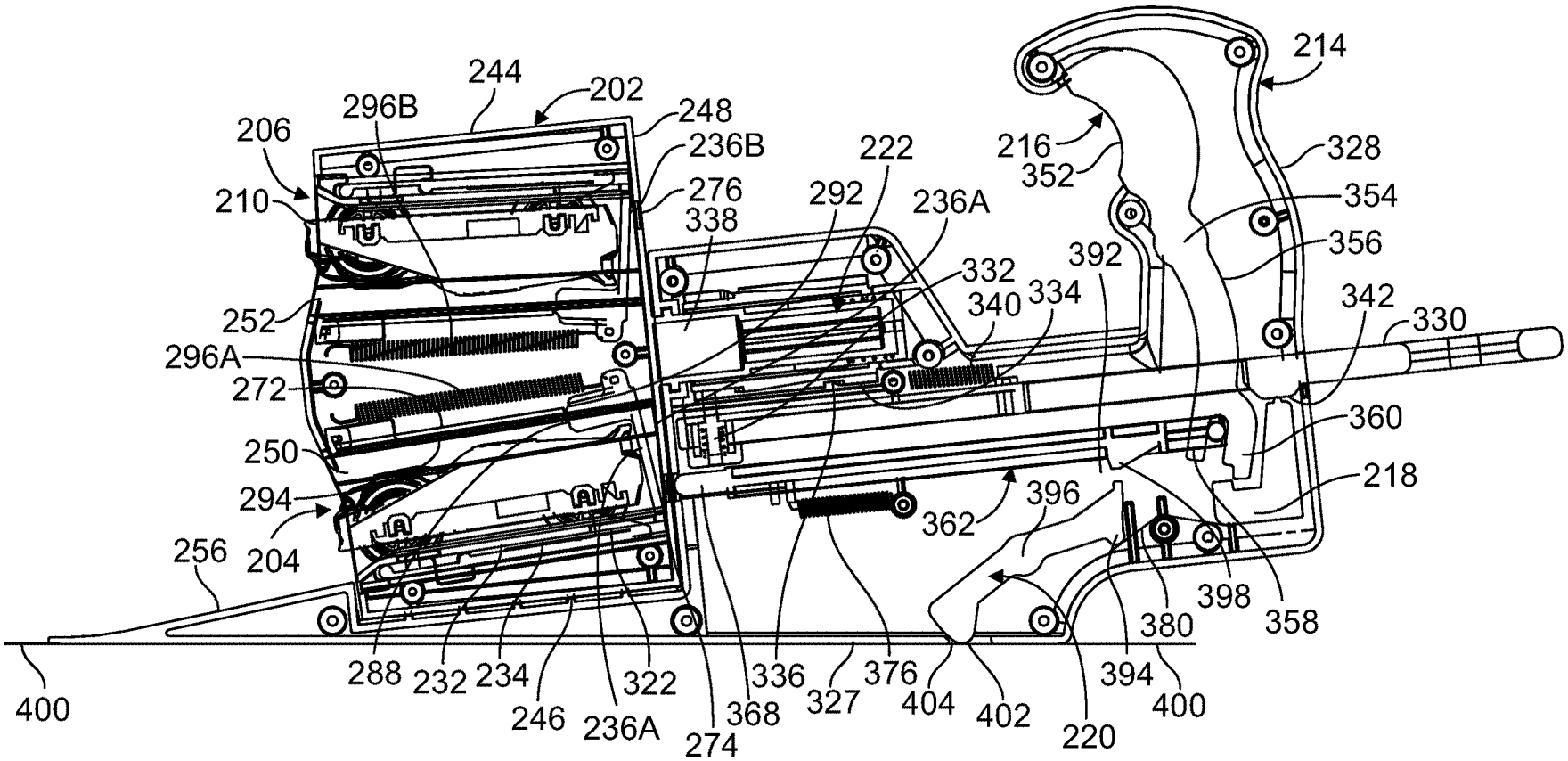
FIG. 17 is a cross-sectional elevation view of the car launcher apparatus shown in FIGS. 15 and 16.

The flip chamber housing 202, FIGS. 16 and 17, includes two sidewalls 240, 242, an initial top wall 244, an initial bottom wall 246, a back wall 248 and two front openings 250, 252, the front openings 250, 252 being used to receive cars to be launched in the same manner as with the toy launcher apparatus 10, the palm of the user's hand. As disclosed above, it is to be understood that other properly configured toys may also be launched, if desired. The chamber housing 202 is divided into two adjacent, top-over-bottom car chambers, the lower chamber 204 aligned initially with a ramp 256, FIG. 15, of the support housing 214. The upper chamber 206 is configured upside down when compared to the lower compartment 204. Each chamber includes a launcher mechanism and each launcher mechanism includes the fixed upper base 230, FIG. 18, the upper base 230 having a long longitudinal slot 262, a U-shaped bumper wall 264 and a spring connector 266 mounted to the bumper wall 264. Bordering each of the sides of the slot 262 are two blocking ribs 270, 272, that function to restrain the ejector 236 when the ejector 236 is in a cocked or biased configuration as shown in FIGS. 15 and 17. The back wall 248 of the chamber housing 202 includes two openings 274, 276 for releasing the ejectors 236A and 236B, respectively, as will be explained below.

Figure 18:
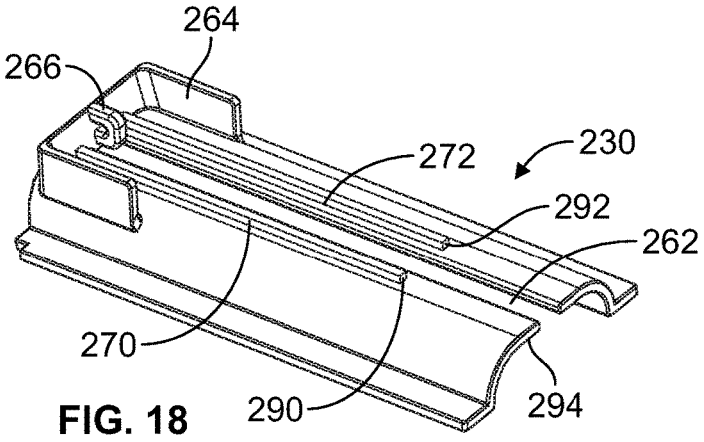
FIG. 18 is an isometric view of an upper base of the car launcher apparatus shown in FIGS. 15-17.
Figure 19:
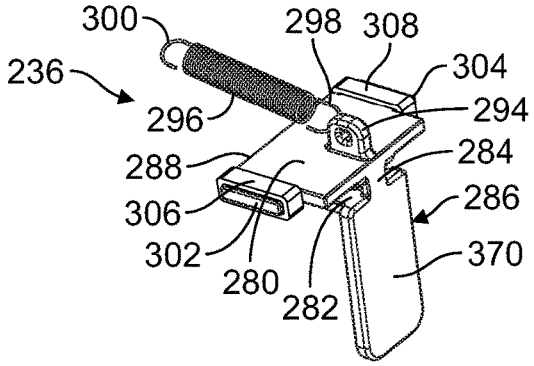
FIG. 19 is an isometric view of an ejector of the car launcher apparatus shown in FIGS. 15-17.

The ejector 236, FIG. 19, is mounted to the upper base 230 to move along the slot 262 from a relaxed position shown in chamber 204 in FIG. 16, to a cocked position shown in both chambers in FIG. 15. The ejector 236 has an upside down, generally L-shape in profile with a wide top flange 280, a more narrow bottom flange 282, a cross member 284 connecting the top and bottom flanges, and a paddle 286 for making contact with the rear 58 of the inserted toy car. The top flange portion 280 includes a trailing or rear edge 288 for engaging end surfaces 290, 292, FIG. 18, of the blocking ribs 270, 276 when the ejector 236 is in the cocked position best shown in FIGS. 17 and 30. A spring connector 294 is mounted to the top flange 280. The top flange 280 rides along the ribs 270, 272 as the ejector 236 is pushed rearward by the inserted car from the relaxed or unbiased position to the cocked or biased position. Simultaneously, the bottom flange 282 is guided by an underside 294, FIG. 18, of the upper base 230.

Figure 22:
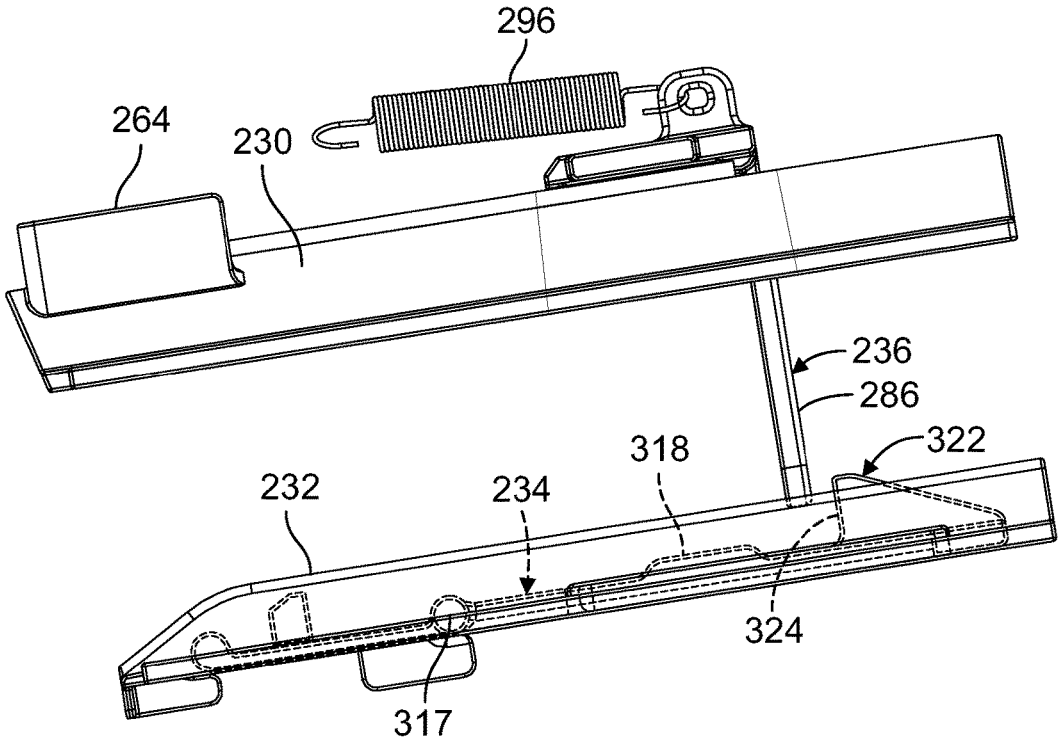
FIG. 22 is a side elevation view of a portion of the car launcher apparatus shown in FIGS. 15-17, illustrating the ejector and a launch spring at rest.
Figure 23:
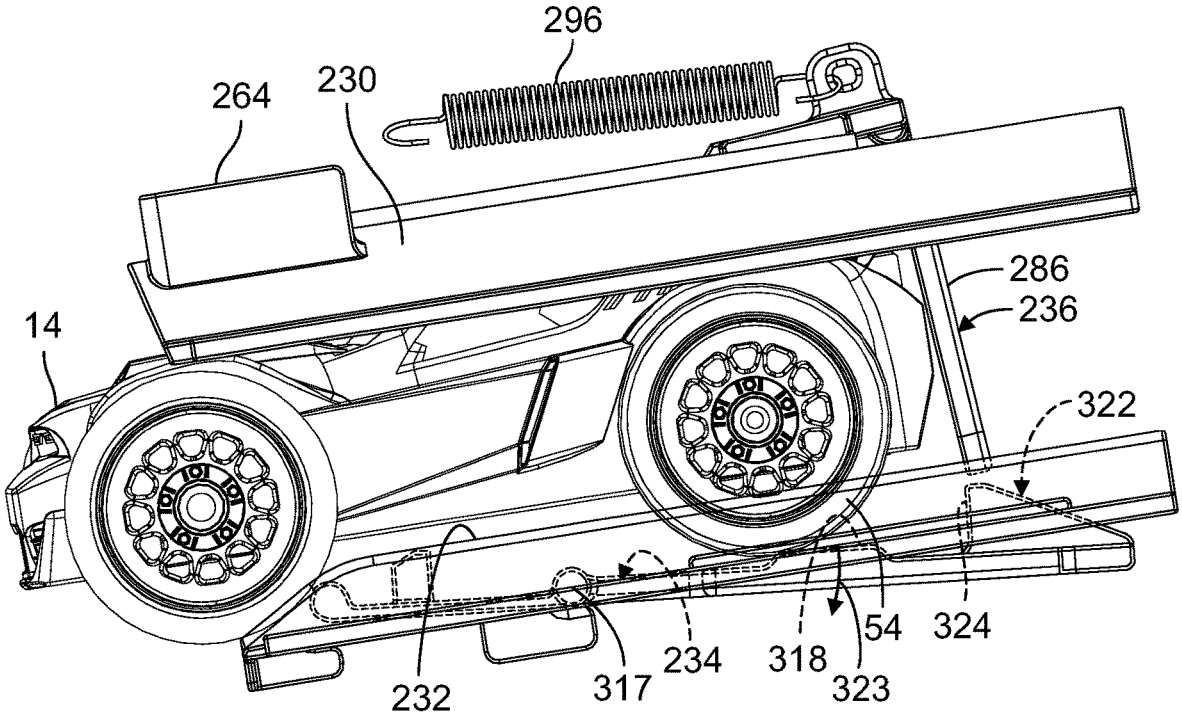
FIG. 23 is a side elevation view of a portion of the car launcher apparatus shown in FIGS. 15-17, illustrating the ejector and the launch spring after the ejector has been pushed back by the insertion of the toy car.
Figure 24:
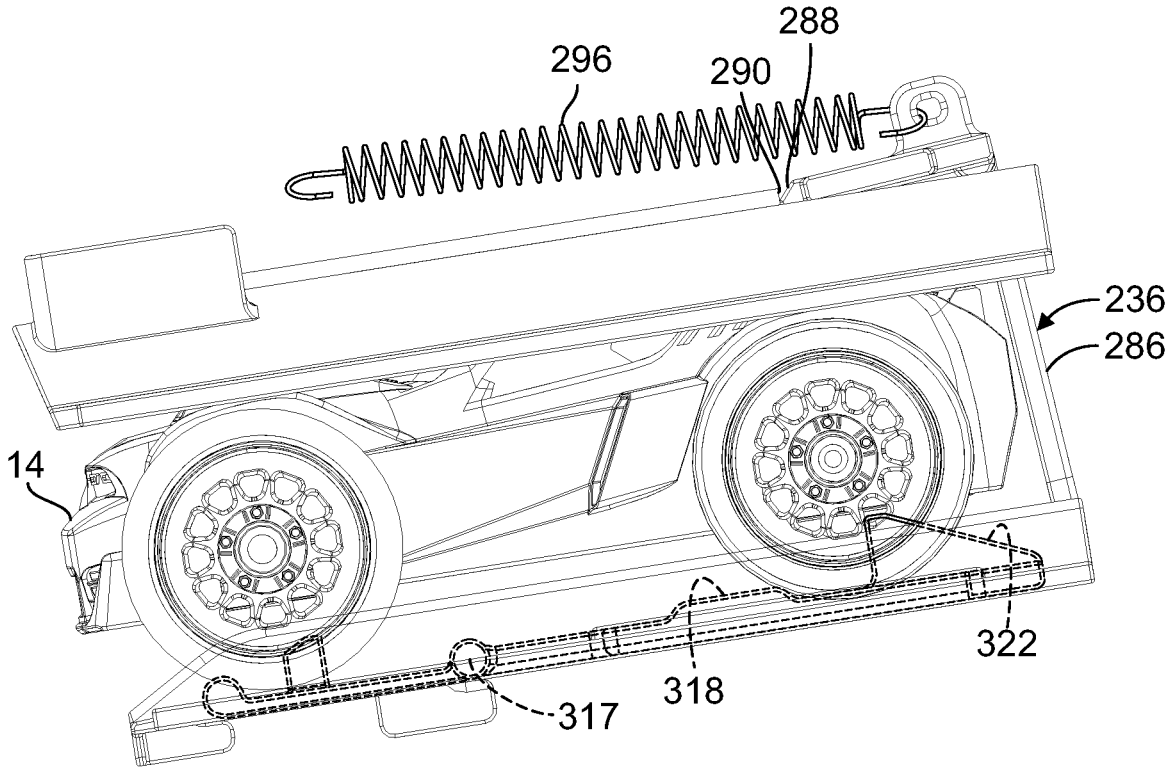
FIG. 24 is a side elevation view of a portion of the car launcher apparatus shown in FIGS. 15-17, illustrating the ejector and a launch spring in a fully cocked configuration.

The sequence of movement of the toy car and the ejector are shown in FIGS. 22-24. 24.

Figure 30:
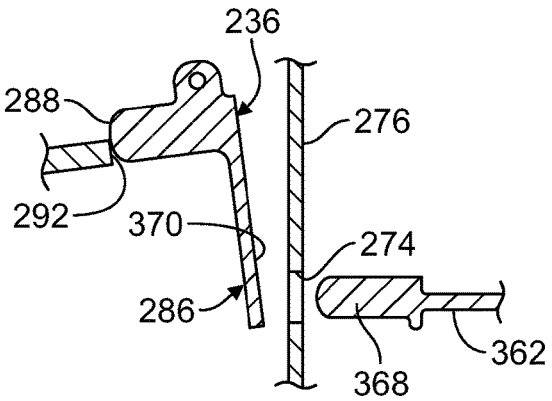
FIG. 30 is a diagrammatic partial side elevation view of the ejector and a portion of the trigger mechanism illustrating the ejector in a cocked position.
Figure 31:
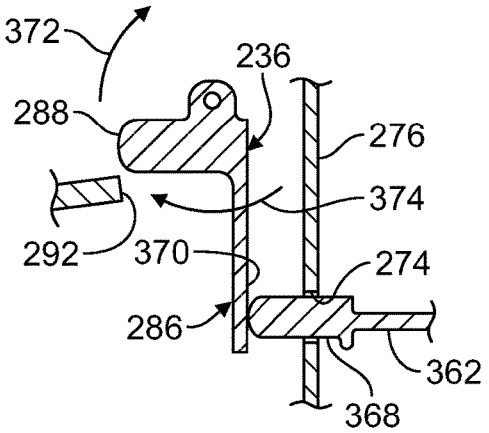
FIG. 31 is a diagrammatic partial side elevation view of the ejector and the trigger portion of the mechanism illustrating the ejector being released.

A launch spring 296, or other extendible element, is mounted at one end 298 to the spring connector 294 of the ejector 236 and at an opposite end 300 to the spring connector 266 of the upper base 230 such that when a toy car is inserted or loaded into a car chamber the ejector is moved from the relaxed position to the cocked position where the ejector becomes biased by stretching the launch spring 296. The extended launch spring 296 provides the energy or force to cause a toy car launch when the launch spring 296 and the ejector 236 are released. When the ejector 236 is in the cocked position the trailing edge 288, FIG. 30, of the ejector engages the end surfaces 290, 292 of the blocking ribs 270, 272, and because of the force exerted by the launch spring 296, the ejector 236 tilts slightly as shown clearly in FIGS. 17 and 30, in that the paddle 286 pivots counterclockwise (as viewed in the bottom chamber 204 in FIG. 17) because the upper flange also pivots counterclockwise and abuts or 'digs in' against the end surfaces 290, 292 of the ribs 270, 272. Pushing the paddle 286, as shown in FIG. 31, to a non-tilted position causes the ejector 236 to swing away from the end surfaces and be released as will be explained in more detail below.

The bumper wall 264, FIG. 18, acts as a stop for the ejector 236. When the ejector 236 is released it snaps back to its relaxed position and the bumper wall 264 stops extended wings 302, 304 of the upper flange portion 280. Resilient bands 306, 308 may be placed around the wings to further cushion the impact between the ejector 236 and the bumper wall 264.

Figure 20:
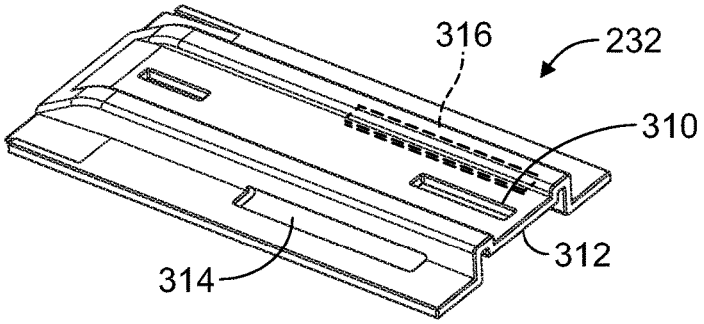
FIG. 20 is an isometric view of a lower base of the car launcher apparatus shown in FIGS. 15-17.

The lower base 232, FIG. 20, is fixed to each car chamber of the rotational chamber housing 202 and becomes the car chamber floor. A flex member 234 is mounted to each of the lower bases 232. The lower base 232 includes a short center slot 310 located at a rearward portion 312 of the lower base, and two longer, laterally located slots 314, 316 are positioned slightly forward of the center slot 310.

Figure 21:
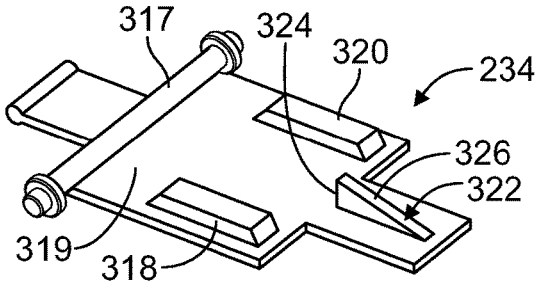
FIG. 21 is an isometric view of a flex member of the car launcher apparatus shown in FIGS. 15-17.

As with the launcher apparatus 10 disclosed in relation to FIGS. 1-14, the inventive launcher apparatus 200 also features an important safety component that restricts launchings only to those objects that have a proper configuration such as the toy car 14. Objects that do not have conforming configurations will not allow the launcher apparatus to be cocked. Like the flex member 18, the flex member 234, FIG. 21, is mounted to the lower base 232 to allow the flex member 234 to deflect or bend about an axis 317 in response to an engagement with an inserted toy. In a somewhat upside down arrangement from that of the flex member 18, the flex member 234 has a top surface 319 from which extends protrusions 318, 320. The protrusions 318, 320 extend through the lateral slots 314, 316 of the lower base 232, and an obstruction 322 extends through the center slot 310. The obstruction 322 includes a blocking surface 324 that extends into the path of the ejector 236 as it attempts to move from the relaxed position to the cocked position and will prevent the ejector from being cocked if nothing else happens. The obstruction 322 also includes a sloped surface 326 for allowing the ejector 236 to deflect the flex member when the ejector is snapped forward during launch, from the cocked position to the relaxed position. The protrusions 318, 320 extend in the path of the rear wheels 54, 56 of the toy car 14 and when contact is made, the rear wheels depress the protrusions and deflect the flex member 234 to move the obstruction 322 away from the path of the ejector.

When the user inserts the toy car 14 into a car chamber, the rear wheels 54, 56 of the car depress the protrusions 318, 320, as mentioned, causing the flex member 234 to deflect the obstruction 322 out of the way of the ejector 236. This allows the ejector to be pushed by the toy car to its cocked position. The sequence of movement of the flex member 234 is best shown in FIGS. 22-24. The relaxed position of the flex member 234, as well as the ejector 234, and the launch spring 296, is shown in FIG. 22, the interaction between the toy car and the flex member 234 where the flex member is deflected as indicated by an arrow 323 is shown in FIG. 23, resulting in the obstruction 322 being moved out of the way of the ejector 236, and the cocked position is shown in FIG. 24, where the flex member 234 has returned to its relaxed condition and the launch spring 296 is extended.

The configuration, the positions and the movement of the flex member is designed to operate when a properly configured toy is inserted for launch. If however, an attempt is made to insert an object that is not properly configured, the protrusions 318, 320 will not be depressed and the blocking surface 324 of the obstruction 322 of the flex member 234 will remain upright and prevent rearward movement of the ejector 236.

The support housing 214, FIG. 15, includes the forward ramp 256 and a planar bottom wall 327 extending between the ramp 256 and a rearward upstanding handle 328, as well as a stabilizing foot 329. Mounted in the support housing 214 is the trigger mechanism 216 and below the trigger mechanism is the trigger lock 218. Also mounted in the support housing is the safety latch 220 located forward of the trigger lock 218 and the rotational mechanism 222 which is mounted forward of the upstanding handle 328.

After a car is launched from the car chamber occupying the lower position adjacent the ramp 256, the user is able to operate the rotational mechanism 222 to reverse the locations of the car chambers such that the chamber from which a car was just launched is moved upward and a car loaded chamber is moved downward from the upper position to the lower position. Rotation of the chamber housing 202 is illustrated in FIG. 16, where the chamber housing is shown about half way from one position to another. The rotational mechanism 222, FIGS. 15 and 17, is mounted in the support housing 214 just to the rear of the chamber housing 202 and includes a pull lever 330 with a spring loaded pin 332, a cylinder 334 with a helical groove 336 and a corresponding longitudinal groove 337, and a connector 338 to the chamber housing 202. When the pull lever 330 is pulled outward or rearward, the pin 332 moves along the helical groove 336 causing the cylinder 334 and the chamber housing 202 to rotate. The rotating cylinder 334 causes the chamber housing to rotate or flip 180° so as to first line up one of the car chambers and then the other car chamber. A return spring 340 is mounted at one end to the pull lever 330 and at the other end to the support housing 214. A depending protrusion 342 on the underside of the pull lever 330 prevents the trigger lock 218 from engaging the trigger mechanism 216 when the pull lever 330 is in its inward or forward position as shown in FIG. 17.

Figure 25:
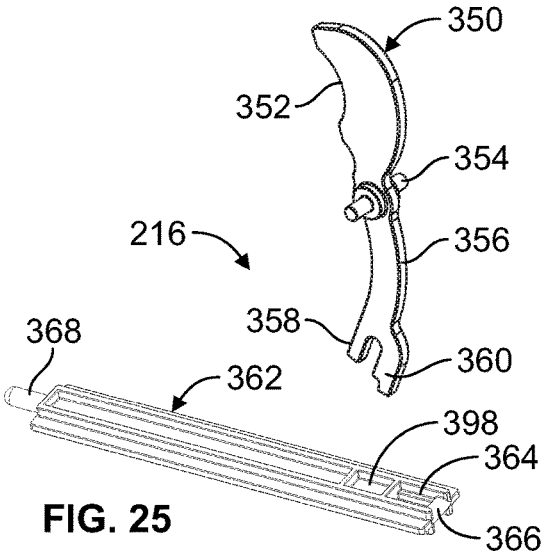
FIG. 25 is an isometric view of a trigger mechanism of the car launcher apparatus shown in FIGS. 15-17.
Figure 26:
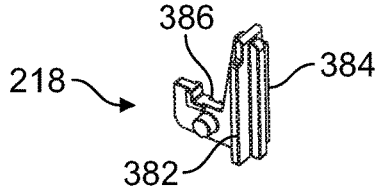
FIG. 26 is an isometric view of a trigger lock of the car launcher apparatus shown in FIGS. 15-17.

The trigger mechanism 216 is mounted to the support housing 214 and includes a pivotal trigger arm 350, FIGS. 17 and 25, having a finger portion 352 located above a pivot connection 354 and protruding outside of the support housing to enable an operator to depress the finger portion 352. A lower portion 356 of the arm 350 below the pivot connection 354 extends down the upstanding handle 328 of the support housing and divides into front and rear tabs 358, 360. The tabs engage a generally horizontal link 362 of the trigger mechanism 216 around an opening 364 and a bar 366 so that when the finger portion 352 of the arm 350 is pressed by the user, the link 362 is pushed forward. The rearward tab 360 selectively engages the trigger lock 218. The link 362 includes a nose portion 368 that extends forward into one of the two small openings 274, 276 in the back wall 248 of the chamber housing 202 that is aligned with the ramp 256. The nose portion 368, FIGS. 30 and 31, is able to engage a back surface 370 of the paddle portion 286 of the ejector 236 and push the paddle portion 286 in a clockwise direction shown by arrows 372, 374 causing the leading edge 288 of the ejector 236 to pivot and disengage from the end surfaces 290, 292 of the upper base 230 causing the ejector to pivot and be released. With disengagement, the launch spring 296 and the ejector snap back from the cocked position to the relaxed position. A return spring 376, FIG. 17, is connected to the main housing and to the link 362 to bias the link 362 of the trigger mechanism 216 to the rear when pressure on the finger portion 352 is removed.

The trigger lock 218 is mounted to the support housing 214 and is biased upward by a torsion spring 380, FIG. 17, to engage the rear tab 360 of the lower portion 356 of the trigger arm 350. The trigger lock includes guide arms 382, 384, FIG. 26, and a recess 386 for receiving the rearward tab 360 of the trigger arm 350 when the protrusion 342 is pulled away from the trigger lock. When the pull lever 330 is disposed inward, the protrusion 342 prevents the biasing spring 380 from lifting the trigger lock 218. However, when the pull lever 330 is pulled outward to rotate the chamber housing 202, the trigger lock 218 is able to move upward so that the recess 386, FIG. 27, receives the tab 360 to prevent rotation of the trigger arm 350 such that the nose portion 368 of the link 362 is unable to interfere with the rotation of the chamber housing 202. Once rotation of the chamber housing is completed, the return spring 340 moves the pull lever 330 from the outward position to the inward position, and the protrusion 342 on the pull lever once again depresses the trigger lock 218 away from the bottom of the pivotal arm 356 of the trigger mechanism 214.

Figure 28:
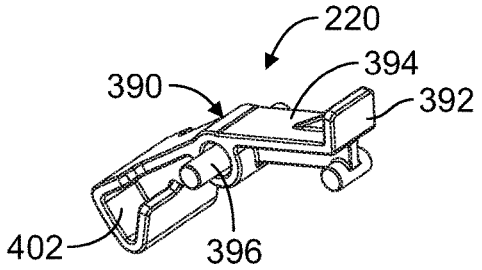
FIG. 28 is an isometric view of a safety latch of the car launcher apparatus shown in FIGS. 13-15.
Figure 27:
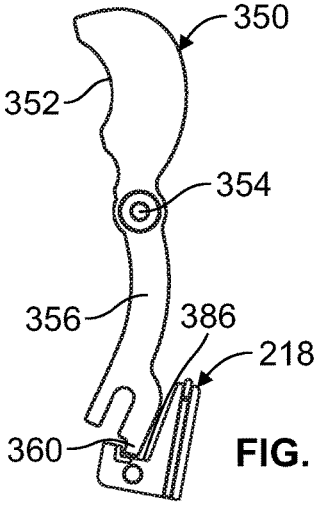
FIG. 27 is a side elevation view of the trigger lock engaging a portion of the trigger mechanism of the car launcher apparatus shown in FIGS. 15-17.
Figure 29:
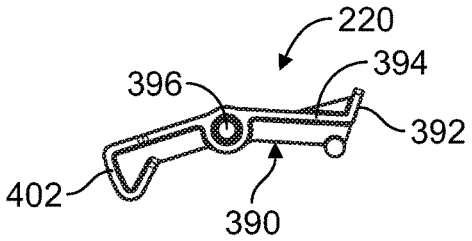
FIG. 29 is a side elevation view of the safety latch shown in FIG. 28.

The safety latch 220 includes the pivotal arm 390, FIGS. 28 and 29, mounted to the support housing 214. An upper tab 392 at a rear end 394 of the arm 390 located above a pivotal connection 396 engages a protrusion 398, FIG. 17, on the link 362 of the trigger mechanism 216 and also prevents the trigger mechanism 216 from movement. Like the single toy launcher apparatus 10 described in detail above, unless the two-car launcher apparatus 200 is disposed on a flat surface 400, such as a table or floor, a launch is prevented. The safety latch 220 is pivotally mounted to the support housing 214 and includes the rear end 394 and a front end 402 extending from the pivot connection 396 downward through an opening 404 in the bottom wall 324 of the support housing 214. The front end 402 of the arm 390 may have a triangular shape. The rear end 394 extends upward toward the link 362, which includes the protrusion 398 that engages the upper tab 392 unless the apparatus is set against the flat surface 400. When set on the flat surface the pivotal arm 390 rotates away from engagement between the protrusion 398 and the tab 392.

In operation of the launcher apparatus 200, the user pushes a toy car into each of the two car chambers, back end first, using the palm of the user's hand. The rear of each car contacts and pushes the corresponding ejector in each car chamber rearward until the ejector abuts the end surfaces 290, 292 of the blocking ribs 270, 272 causing each ejector to tilt slightly. During rearward movement of the toy car, the rear wheels depress the protrusions 318, 320, which are in the path of the rear wheels, causing the flex member 234 to deflect and move the obstruction 322 out of the path of the ejector. To launch, the user must place the support housing on a surface 400 to disengage the safety latch 220. Thereafter, the trigger may be pulled. After the first launch the user may retract the pull lever 330 to cause the chamber housing to rotate 180° to align the second car chamber with the ramp. Again, the user must place the support housing on a surface and pull the trigger.

Another embodiment of the inventive launcher apparatus is described and shown in relation to FIGS. 32-45, where a multi-car, hand held launcher apparatus 500, FIGS. 32-35, includes a support housing 502, a detachable toy car chamber housing or drum 504, forward and rearward drum latches 505, 506, a rotational mechanism 508, a trigger mechanism 510, a trigger lock 512 and a safety latch 514, all analogous to the mechanisms of the launcher apparatus 10 and 200 described in great detail above (except for the drum latches).

Figure 32:
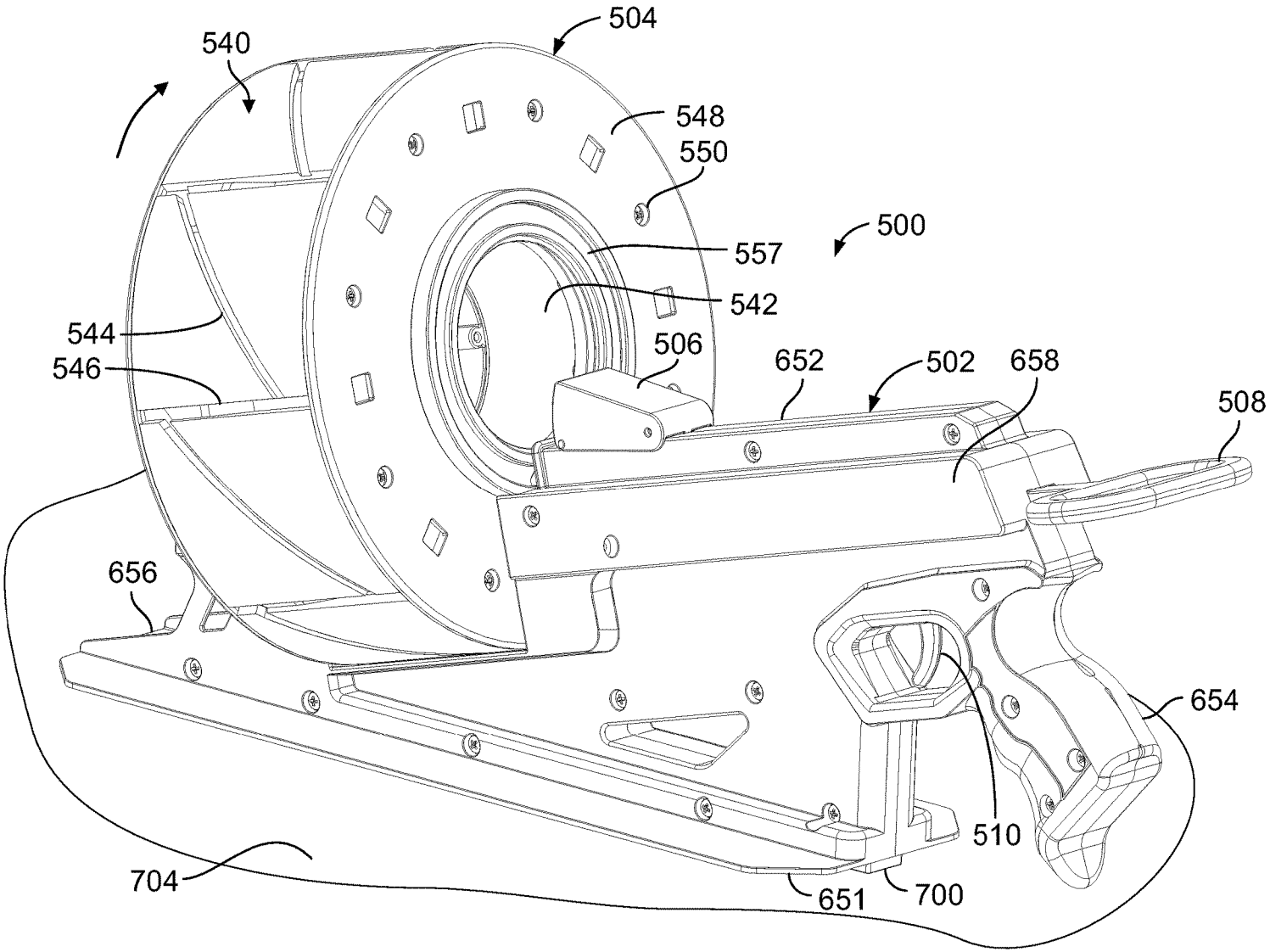
FIG. 32 is an isometric view of a preferred embodiment of the present invention in the form of a toy car launcher apparatus for ten toy cars.
Figure 33:
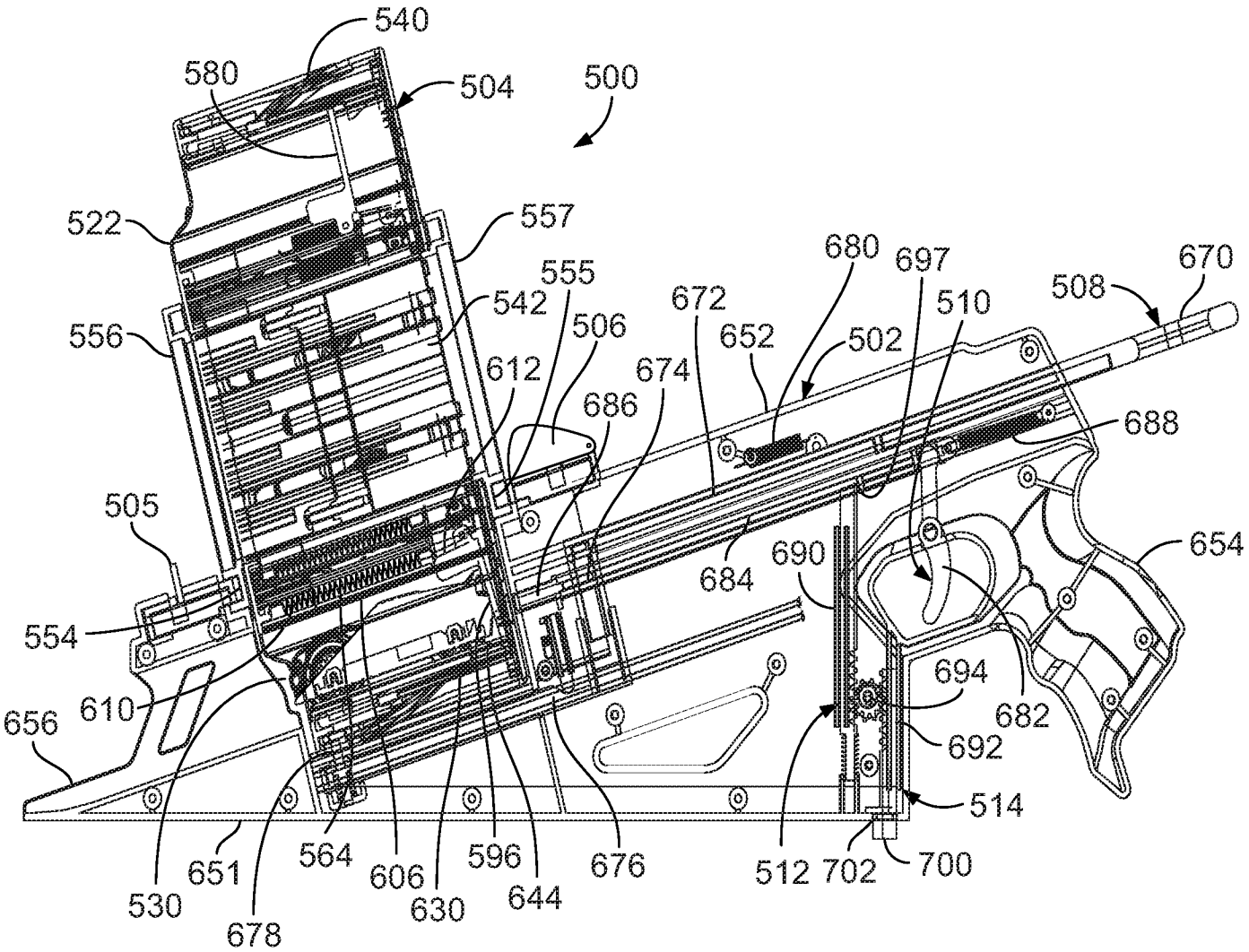
FIG. 33 is a cross-sectional elevation view of the car launcher apparatus shown in FIG. 27.
Figure 34:
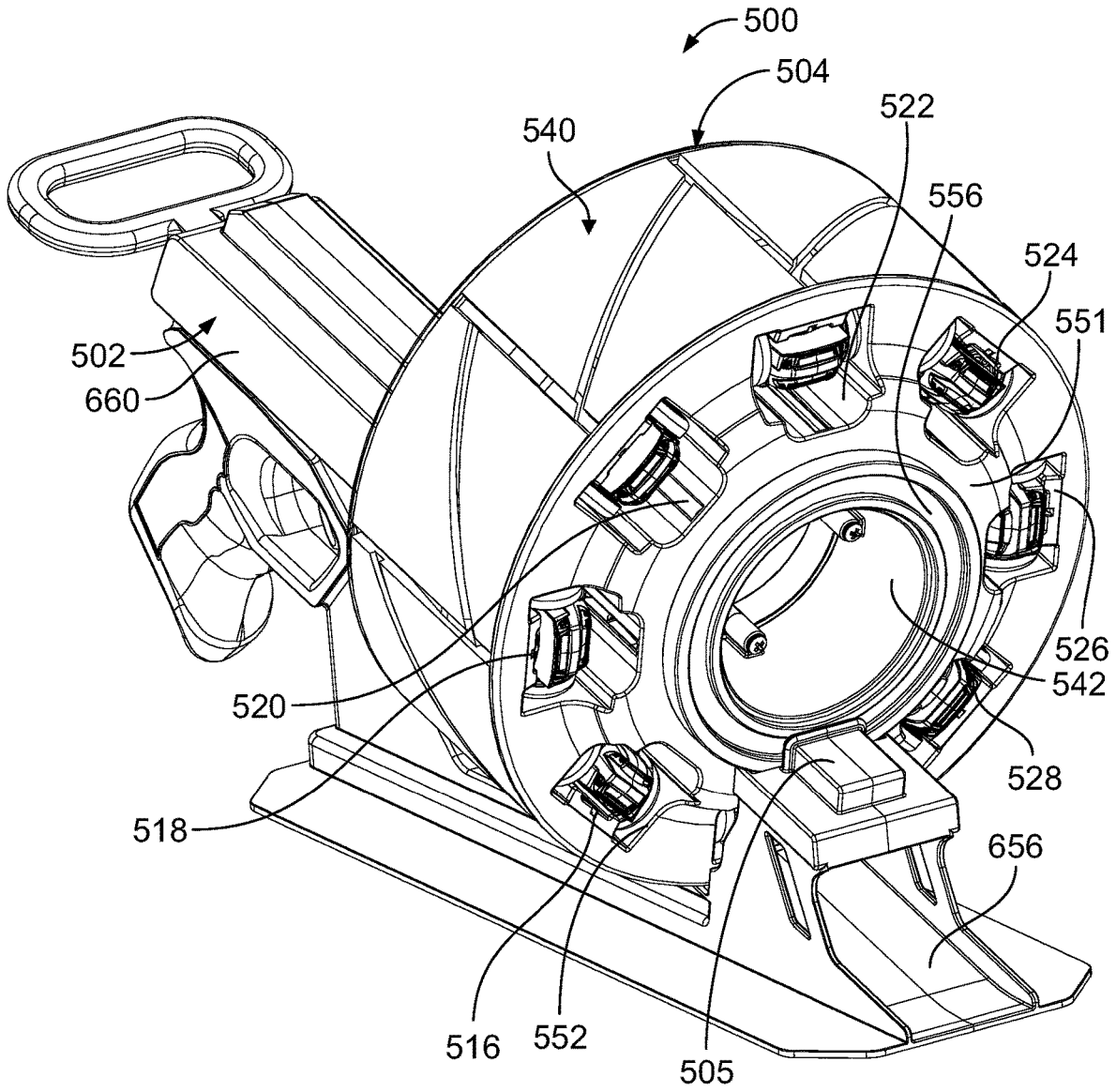
FIG. 34 is a front three-quarter isometric view of the car launcher apparatus shown in FIGS. 32 and 33.

The chamber housing or drum 504 is divided into eight toy or car chambers 516, 518, 520, 522, 524, 526, 528, 530, FIGS. 33 and 34, one every 45°, and includes an outer cylindrical wall 540, FIGS. 32 and 34, and an inner cylindrical wall 542, the chamber housing for storing eight toy cars or other conforming toys. The outer wall 540 includes eight helical grooves and eight corresponding longitudinal grooves, each also spaced every 45°, the helical grooves being exemplified by the helical groove 544, FIG. 32, and the corresponding longitudinal groove being exemplified by the longitudinal groove 546. The grooves may be used for rotation of the chamber housing as will be described in detail below. The chamber housing 504 includes a rear wall 548 with eight small trigger openings, exemplified by the small opening 550, which are used to launch the toy cars in the same manner as shown and described in relation to FIGS. 30 and 31. The chamber housing 504 also includes a front wall 551, FIG. 34, with eight openings, exemplified by the opening 552 of the car chamber 516, the toy car openings being used to load toy cars to be launched similar to the launcher apparatus 10 and just like the launcher apparatus 200.

The operator may load the toy cars into the drum 504 while the drum is mounted to the support housing 502, or in the alternative, when the drum is detached from the support housing 502. The drum latches 505, 506 are spring loaded and engage recesses 554, 555, FIG. 33, in front and rear rings 556, 557 in the drum 504. To detach the drum, the operator pushes the rear latch 506 rearwards and tilts the drum to free the drum from both of the latches 505, 506. The operator may then set the drum on a flat surface, such a floor, front side up, and load toy cars into the car chambers. To reattach the drum 504 to the support housing 502, the operator may align the drum with the support housing and the front latch 505 with and in the recess 554, pull back on the rear latch 506 until the rear latch and the recess 555 are aligned and then release the rear latch. Or in the alternative, the drum may be pushed downward on slanted or beveled upper surfaces of the drum latches to bias the latches against their springs. When the operator pushes downward on the drum, the latches retract until they are aligned with their respective recesses allowing the latches to snap back into the recesses and reattach the drum to the support housing.

Figure 35:
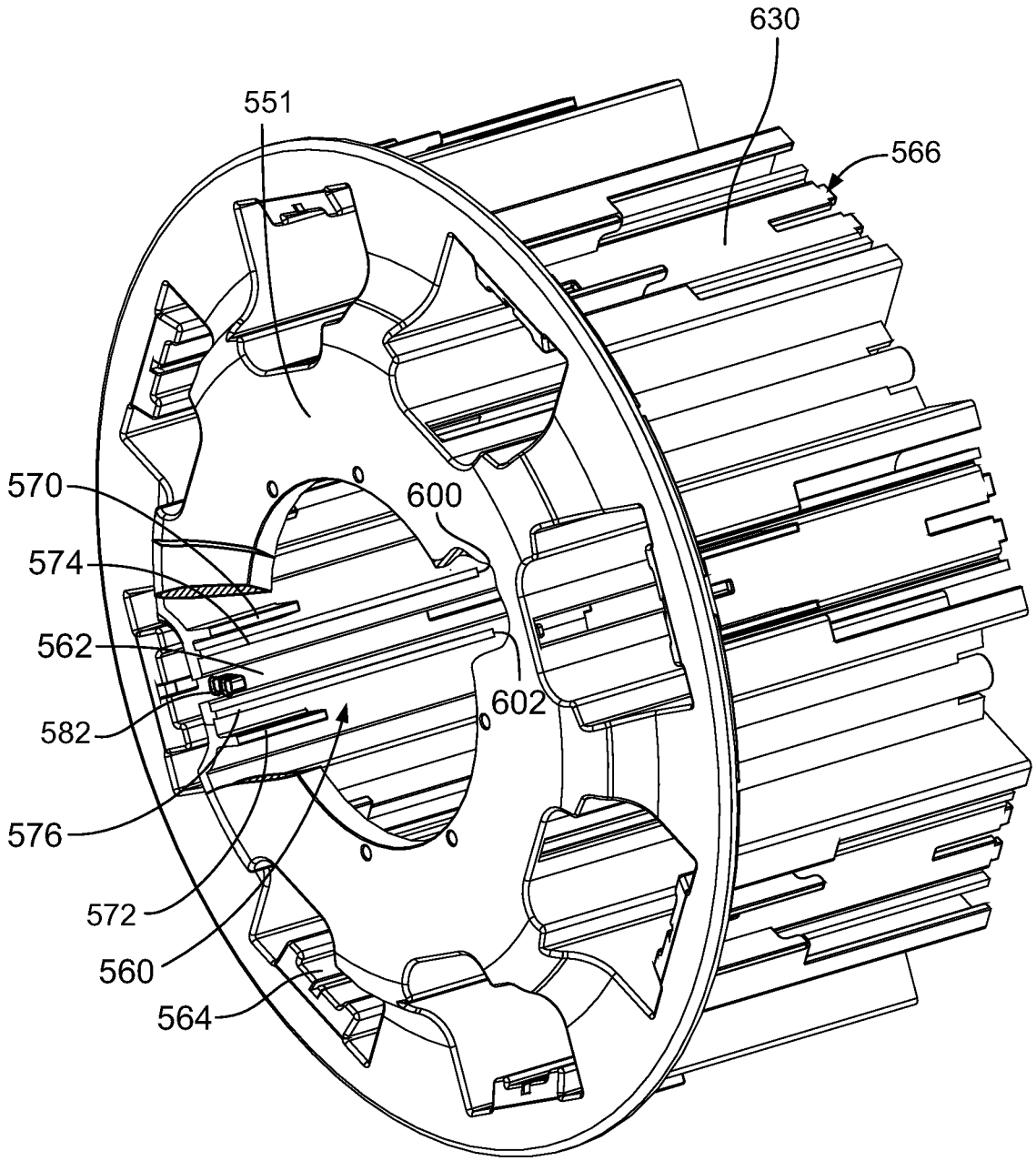
FIG. 35 is a partially broken away isometric view of a mold having eight upper and lower bases of the car launcher apparatus shown in FIGS. 32-34.

Each car chamber includes a launcher mechanism nearly identical to that described in detail above for the two-car launcher apparatus 200. Each launcher mechanism includes an upper base, such as the upper base 560, FIG. 35, and each upper base has a longitudinal slot, such as the slot 562, and a lower base, such as the lower base 564. However, different from the launcher apparatus 200, the eight upper and lower bases 560, 564 are molded as a single integral part 566, FIG. 35, a cost effective method for manufacturing the apparatus. Each upper base 560 includes a pair of bumper walls 570, 572, and running along both sides of the slot 562 are two blocking ribs 574, 576. The two ribs 574, 576 function to restrain an ejector 580, FIG. 36, when the ejector 580 is in its cocked position. A spring connector 582, FIG. 35, is formed on the front wall 551 of the integral part 566. The lower base 564 is shown cutaway and enlarged in FIG. 37 for clarity.

Figure 36:
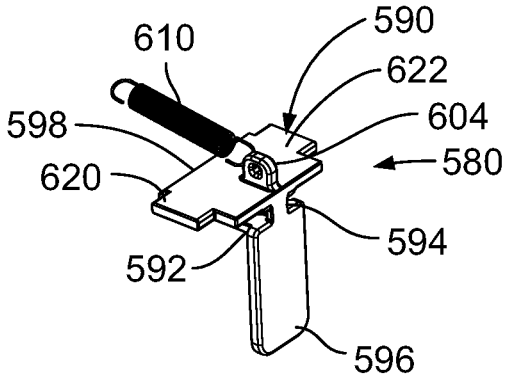
FIG. 36 is an isometric view of an ejector of the car launcher apparatus shown in FIGS. 32-34.

The ejector 580, FIG. 36, is mounted to the upper base 560 to move along the slot 562 from a relaxed or unbiased position shown in the upper chamber 522 of FIG. 33, to a cocked position shown in the lower chamber 530. The ejector 580, like the ejector 236, FIG. 17, has an upside down, approximate L-shape in profile with a wide top flange 590, a more narrow bottom flange 592, a cross member 594 connecting the top and bottom flanges 590, 592, and a paddle 596 for making contact with an inserted toy car. The top flange 590 includes a trailing or rearward edge 598 for engaging end surfaces 600, 602, FIG. 35, of the blocking ribs 574, 576 when the ejector 580 is in its cocked position. A spring connector 604 is mounted to the top flange 590. Like with the ejector 236, the top flange 590 of the ejector 580 rides along the ribs 574, 576 as the ejector is pushed rearward by an inserted car. At the same time, the bottom flange 592 of the ejector is guided by an underside 606, FIG. 37, of the lower base 564.

Figure 39:
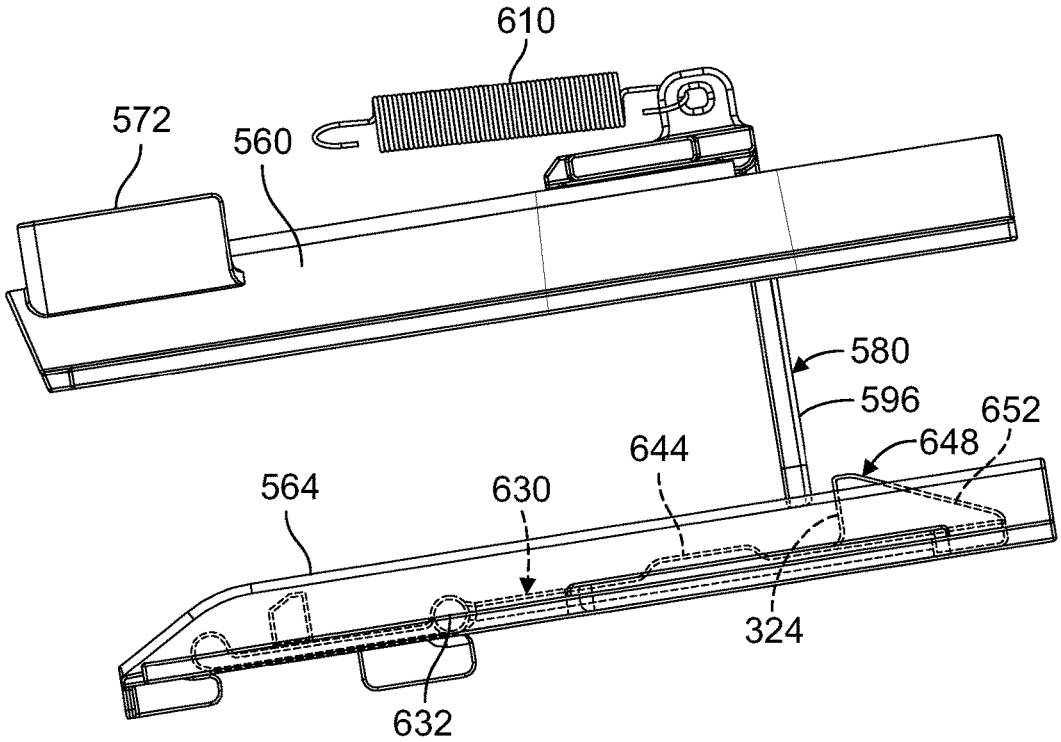
FIG. 39 is a side elevation view of a portion of the car launcher apparatus shown in FIGS. 32-34, illustrating the ejector and a launch spring at rest.
Figure 40:
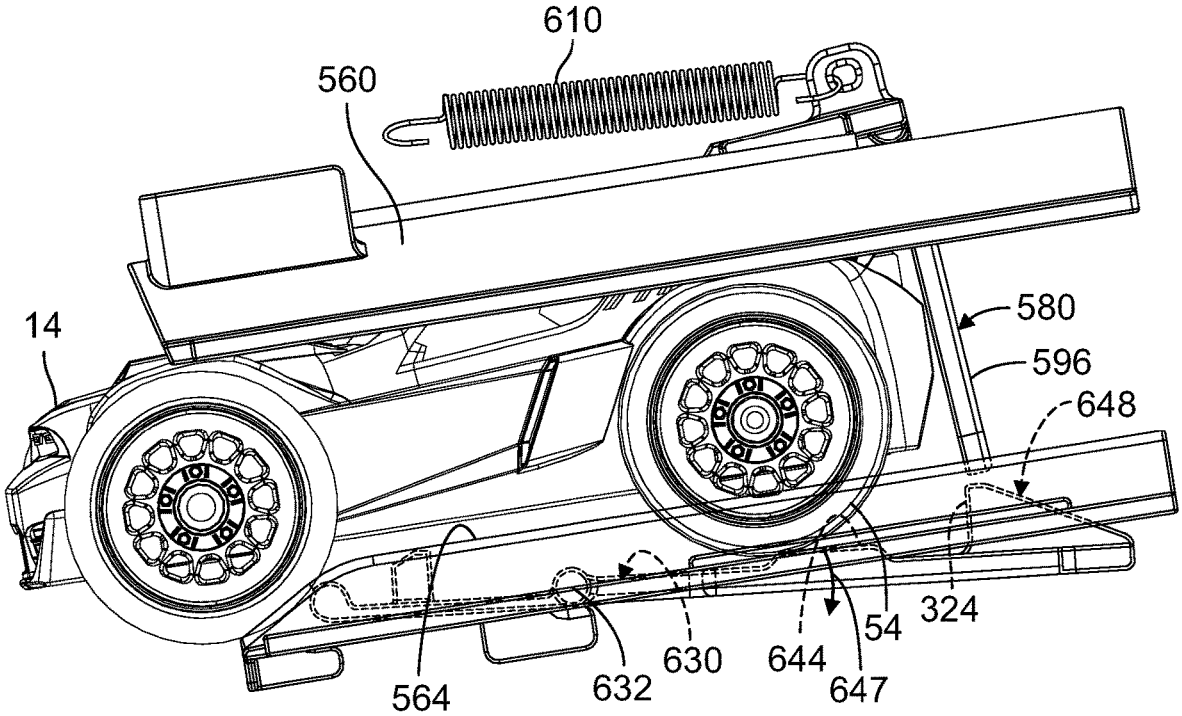
FIG. 40 is a side elevation view of a portion of the car launcher apparatus shown in FIGS. 32-34, illustrating the ejector and the launch spring after the ejector has been pushed back by the insertion of the toy car.
Figure 41:
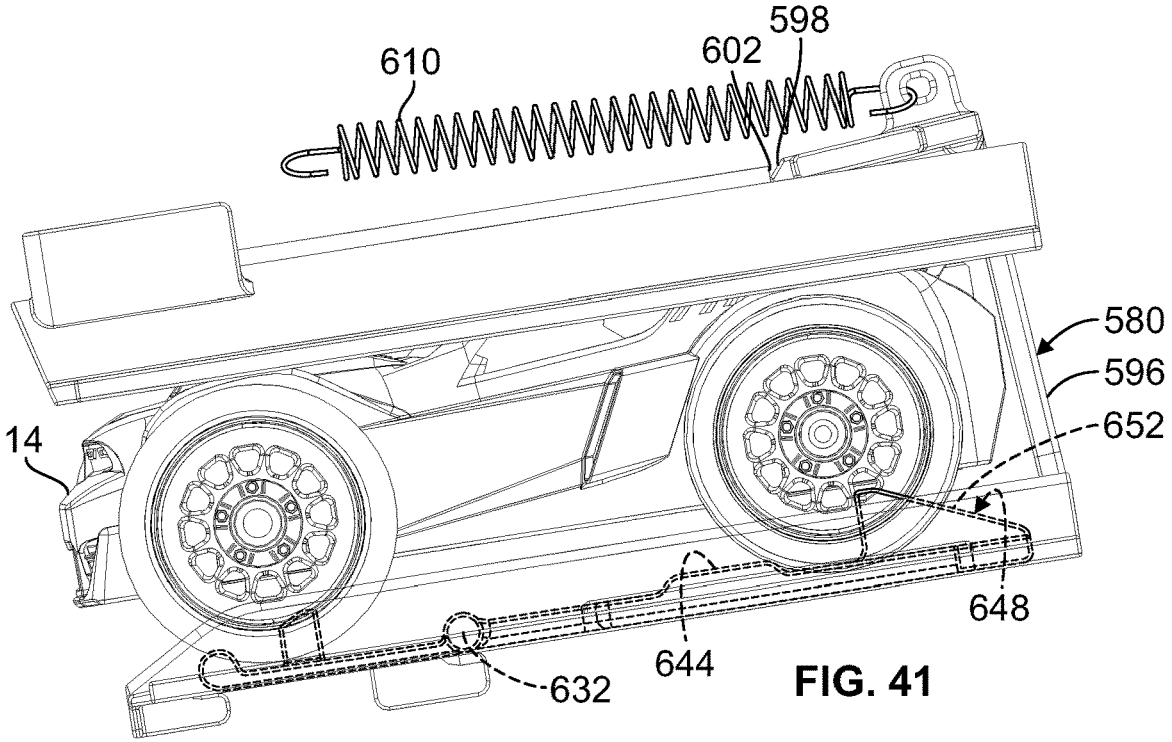
FIG. 41 is a side elevation view of a portion of the car launcher apparatus shown in FIGS. 32-34, illustrating the ejector and a launch spring in a fully cocked configuration.
Figure 42:
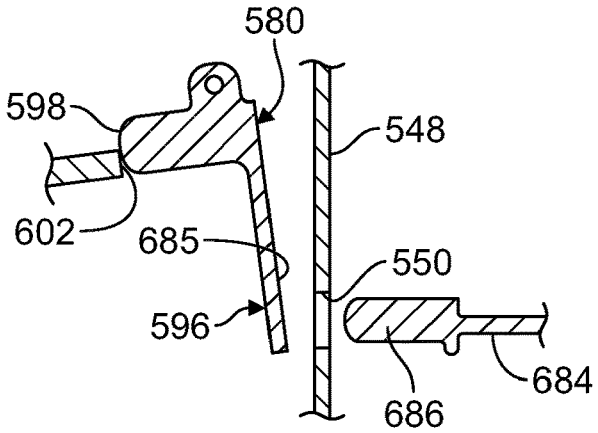
FIG. 42 is a diagrammatic partial side elevation view of the ejector and a portion of the trigger mechanism illustrating the ejector in a cocked position.

An extendible element in the form of a launch spring 610, FIG. 36, is mounted at one end to the spring connector 604 of the ejector 580 and at the opposite end to the spring connector 582, FIG. 35, on the front wall 551 such that when a car is inserted or loaded into a car chamber, the ejector 580 is moved from its relaxed position shown in FIG. 39, to its cocked position shown in FIG. 41, where the spring 610 is extended and the ejector abuts the end surfaces 600, 602 of the blocking ribs. An intermediate position is shown in FIG. 40. The stretched launch spring 610 provides the energy or force to cause a car launch when the launch spring 610 and the ejector 580 are released. When the ejector 580 is in its cocked position the force exerted by the launch spring 610 at the upper end of the ejector 580 causes the ejector to tilt slightly as shown in FIGS. 41 and 42. The paddle 596 pivots counterclockwise because the flange portion 590 also pivots counterclockwise and the trailing edge 598 abuts and 'digs into' the end surfaces 600, 602 of the blocking ribs 574, 576. The movements of the toy car and the ejector 580 are the same as the movements of the toy car and ejector shown in FIGS. 22-24; and the relationship of the ejector 580 and end surfaces 600, 602 of the blocking ribs 574, 576 is the same as the ejector and end surfaces shown and described in relation to FIGS. 30 and 31.

The bumper walls 570, 572, FIG. 35, are located adjacent to the front wall 551 such that when the ejector 580 is released and the launch spring 610 snaps back to its unbiased position, extended wings 620, 624, FIG. 36, of the upper flange 590 are stopped by the bumper walls 570, 572. Resilient bands (not shown in FIG. 36, but identical to the bands 306, 308 shown in FIG. 19) may be placed around the wings 620, 622 to further cushion the impact between the ejector and the bumper walls.

As with the first and the second described embodiments disclosed first in relation to FIGS. 1-14, and second in relation to FIGS. 15-31, the embodiment of the inventive launcher apparatus relating to FIGS. 32-45, also features an important safety component that restricts launching only to those toy objects that have a proper configuration, such as the toy car 14. Objects that do not have conforming configurations will not be able to cock the launcher apparatus. Like the flex member 18, and essentially identical to the flex member 234, the flex member 630, FIG. 38, is mounted to the lower base 564, FIGS. 35 and 37, in a manner like the flex member 234, FIG. 21, is mounted to the lower base 232, FIG. 20. The flex member 630, FIG. 38, is configured just like the flex member 234 to allow the flex member 630 to deflect or bend about an axis 632 in response to engagement with an inserted toy, such as the toy car 14.

Figure 37:
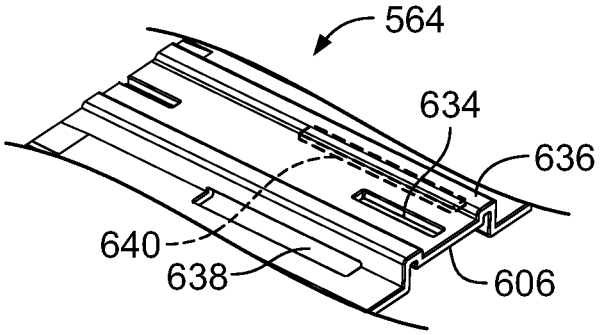
FIG. 37 is a broken away isometric view of a lower base of the car launcher apparatus shown in FIG. 35.
Figure 38:
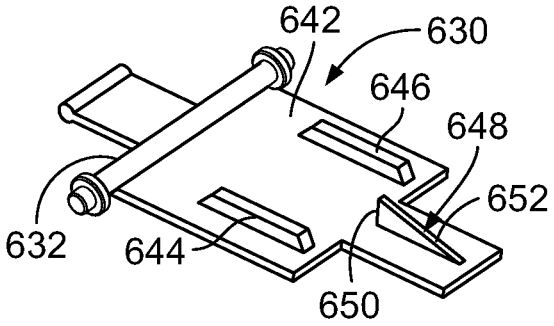
FIG. 38 is an isometric view of a flex member of the car launcher apparatus shown in FIGS. 32-34.

Like the lower base 232, the lower base 564, FIG. 37, includes a center slot 634 located in the rearward portion 636 of the lower base and two lateral slots 638, 640 slightly forward of the center slot 634. The flex member 630 includes a top surface 642 from which extends protrusions 644, 646 that extend through the lateral slots 638, 640 where the protrusions 644, 646 are designed to be in the path of the rear wheels 54, 56 of the inserted toy car 14. The flex member 630 also includes an obstruction 648 that extends through the center slot 634 of the lower base 564. The obstruction includes a blocking surface 650 designed to be in the path of the ejector 580 for blocking the ejector from being cocked. The obstruction 648 also includes a sloped surface 652 for allowing the ejector to deflect the flex member when the ejector is snapped forward during launch of the toy car. When the user inserts the toy car 14 into a car chamber, the rear wheels 54, 56 of the car depress the protrusions 644, 646, FIG. 40, as indicated by an arrow 647, causing the flex member 630 to deflect the obstruction 648 out of the ejector's path allowing the ejector to be pushed by the toy car to its cocked position as shown in FIG. 41.

As mentioned, the sequence of movements of the flex member 630 shown in FIGS. 39-41, are the same as the movements of the flex member 234 shown in FIGS. 22-24, where the relaxed position of the flex member 630, as well as the ejector 580, and the launch spring 610 is shown in FIG. 39, the interaction between the toy car and the flex member is shown in FIG. 40, where the flex member is deflected resulting in the obstruction 648 being moved out of the way of the ejector; and the cocked position shown in FIG. 41, where the flex member is returned to its relaxed condition. If however, an attempt is made to insert an object that is not properly configured, the obstruction of the flex member will remain upright and block rearward movement of the ejector. In the alternative a different toy may have parts spaced differently from the toy car 14, and the flex member and lower base may be reconfigured to complement the different toy.

The support housing 502 includes a planar bottom wall 651, FIGS. 32 and 33, a slanted top wall 652, a handgun style grip 654 at the rear or back end, a ramp 656 at the forward or front end and two sidewalls 658, FIGS. 32, and 660, FIG. 34.

The rotational mechanism 508, FIG. 33, is mounted in the support housing 502 and includes a pull lever 670 connected to one end of an upper rod 672, the other end of the upper rod 672 is connected to a depending link 674, and the link 674 is connected to a lower rod 676. At the forward end of the lower rod 676 is a spring-loaded pin 678 that is mounted to ride sequentially in the eight helical grooves and eight companion longitudinal grooves in the outer wall 540. Hence, the rotational mechanism 508 also includes the eight helical grooves 544 and eight companion longitudinal grooves 546 in the outer wall 540. When the pull lever 670 is extended outward by a user, the pin 678 rides in one of the helical grooves, such as the helical groove 544, FIG. 32, causing the pin to act as a cam to rotate the drum-like chamber housing 45°. When the pull lever 670 is released, a return spring 680, FIG. 33, causes the pull lever 670 to return forward which moves the pin 678 forward along the corresponding longitudinal groove 546. Rotation of the chamber housing 504 moves the next toy car chamber into position aligned with and rearward of the ramp 656.

Figure 43:
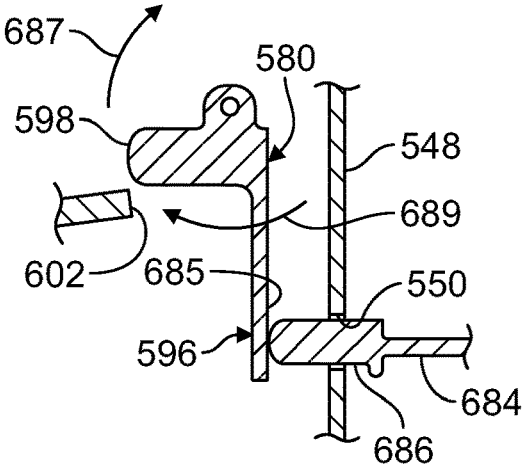
FIG. 43 is a diagrammatic partial side elevation view of the ejector and the trigger portion of the mechanism illustrating the ejector being released.
Figure 44:
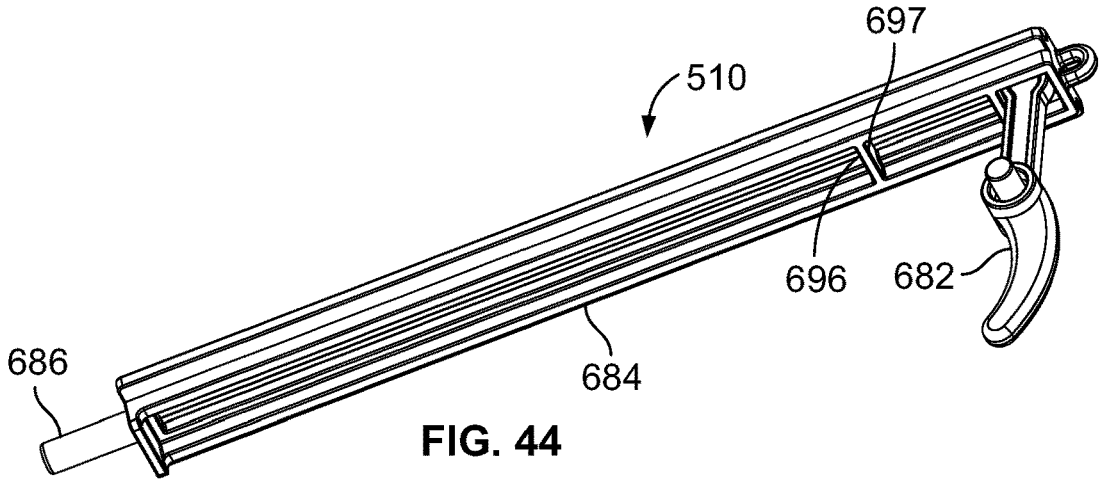
FIG. 44 is an isometric view of a trigger mechanism of the car launcher apparatus shown in FIGS. 32-34.

The trigger mechanism 510 is mounted in the base housing 502 and includes a trigger pull 682, FIGS. 33 and 44, a slidable rod 684 having a nose portion 686, and a return spring 688. The nose portion 686, FIGS. 42 and 43, is located adjacent the back wall 548 of the chamber housing 504. When the trigger pull 682 is activated, the nose portion 686 moves forward through the lowest opening 550 in the back wall 548 so as to bear against a surface 685, also illustrated in FIGS. 42 and 43, of the paddle 596 of the ejector 580 and tip the tilted ejector 580 out of engagement with the end surfaces 600, 602 as shown in FIGS. 42 and 43, where arrows 687, 689 indicate the pivoting motion of the ejector. Tipping the ejector results in the release of the ejector, the launch spring 610, and the toy car in the chamber 530 located adjacent the ramp 656. The arrangement is just like that of the launcher apparatus 200 described in detail above and shown in FIGS. 30 and 31.

Figure 45:
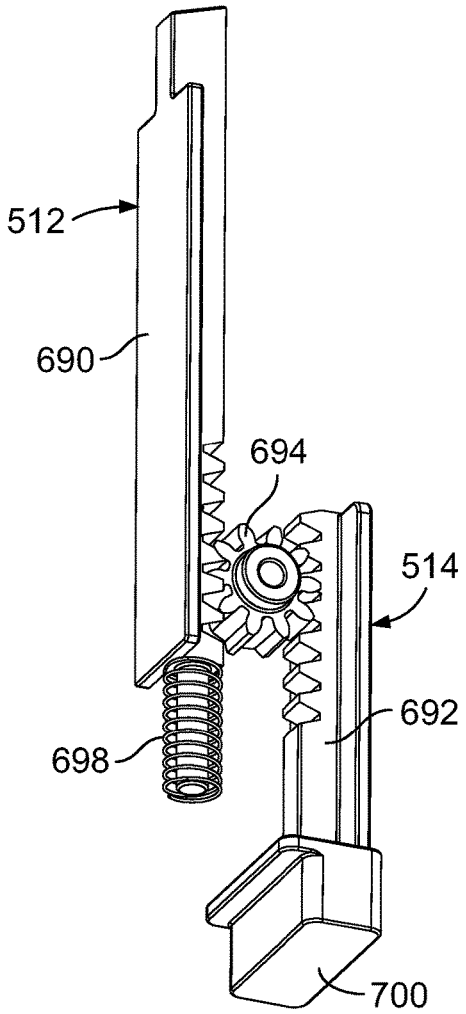
FIG. 45 is an enlarged isometric view of a trigger lock and a safety latch of the car launcher apparatus shown in FIGS. 32-34.
Figure 47:
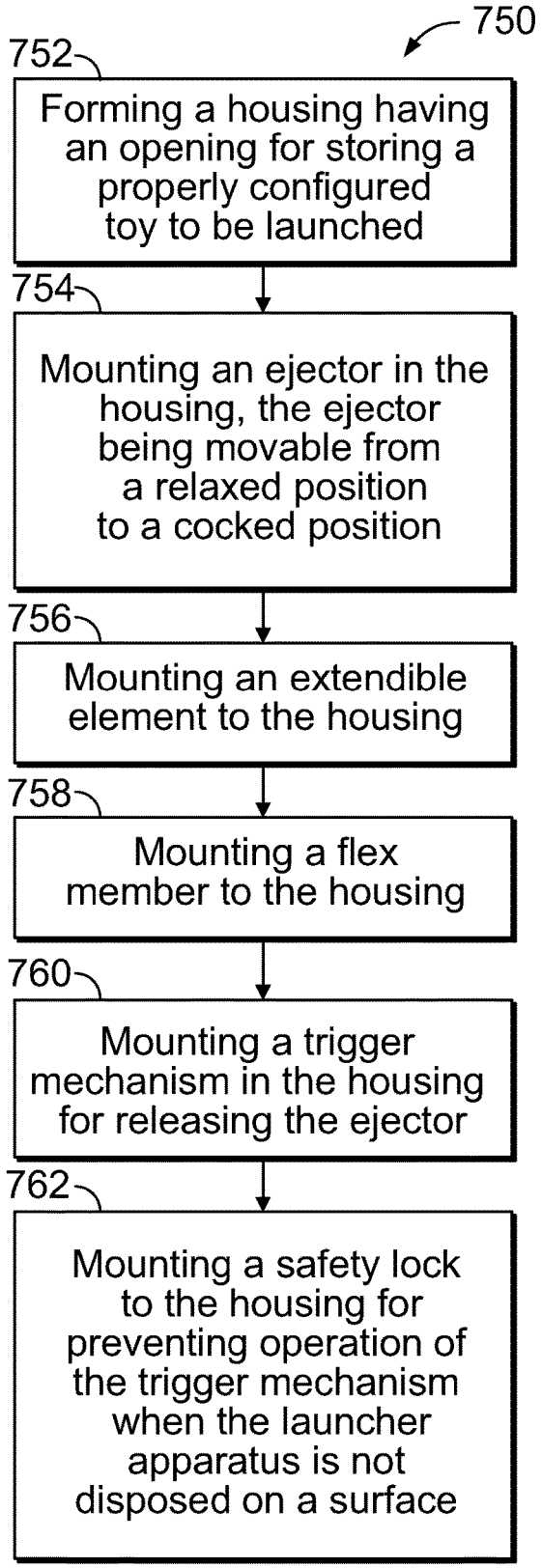
FIG. 47 is a flow diagram of a method for making a toy launcher apparatus.

Forward of the grip portion 654 of the base housing 502 is a trigger lock 512, FIGS. 33 and 45, and a safety lock 514. The trigger lock 512 includes a first rack 690 mounted in the support housing that is engaged with a second rack 692 of the safety lock 514 by way of a gear 694. The trigger lock first rack 690 engages the trigger rod 684, FIG. 44, in a recess 696 forward of a bridge 697 causing the trigger rod to be immovable or locked. The first rack 690 is biased by a spring 698 into locking engagement with the trigger rod 684. The second rack 692 of the safety lock includes a foot 700 projecting through an opening 702, FIG. 33, in the bottom wall 651 of the support housing. When the launcher apparatus 500 is placed or disposed on a surface 704, FIG. 32, such as a floor or table, the foot 700 of the second rack 692 is pushed upward into the support housing causing the gear 694 to rotate counter clockwise. Counter clockwise rotation of the gear 694 (as viewed in FIG. 45) causes the first rack 690 of the trigger lock to move downward causing the first rack 690 to disengage from the trigger rod 684 and compress the return spring 698. Downward movement of the first rack 690 results in the launcher apparatus 500 being in condition for activation of the trigger mechanism 508 to launch a toy car. Once the launcher apparatus is lifted off the surface, the return spring 698 biases the first rack 690 upward to lock the trigger rod 684 to prevent a potentially unwanted launch. The upward movement of the first rack also causes the gear to rotate clockwise which lowers the second rack 692.

Figure 46:
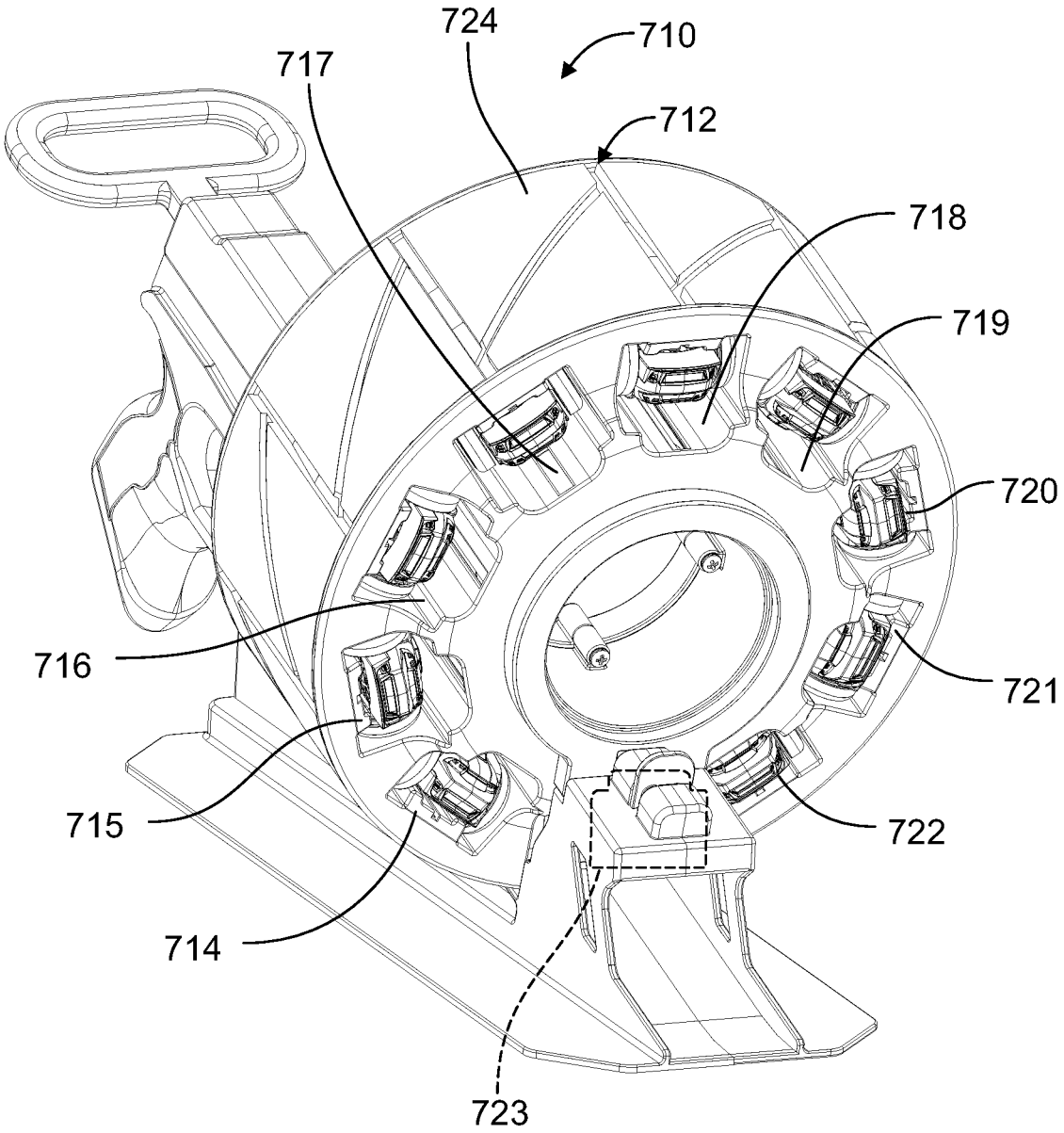
FIG. 46 is a front three-quarter isometric view of another embodiment of a car launcher apparatus, this variation having ten upper and lower bases.

In the alternative, more or less than eight car chambers may be formed in the chamber housing. One example is a chamber housing having six storage chambers spaced every 60° mounted to the support housing, perhaps allowing for larger toys to be launched. Another launcher apparatus embodiment 710, FIG. 46, is illustrated where the drum 712 includes ten car chambers 714, 715, 716, 717, 718, 719, 720, 721, 722, 723, one car chamber every 36°. The launcher apparatus 710 is detachable and the various elements are identical to the elements in the launcher apparatus 500, FIG. 34. There are ten helical grooves and ten corresponding longitudinal grooves in an outer surface 724 that operate like the grooves of the launcher apparatus 500. Or, a differently configured chamber housing may be created such as one having a linear configuration (instead of the drum configuration) that is indexed with each launch.

In operation of the launcher apparatus 500, the user may push a toy car into as many of the eight chambers as desired, back end first, using the palm of the user's hand. The rear of each car contacts and pushes the corresponding ejector in each chamber rearward until the ejector abuts the blocking ribs causing each ejector to be cocked and to tilt slightly as shown in FIGS. 39-41. During rearward movement of each toy car, the rear wheels of the car are configured to engage the protrusions and depress the flex member. Depressing or deflecting the flex member causes a blocking obstruction to deflect out of the way of the ejector's path. To launch, the user must place the support housing on a surface to disengage the safety latch thereby allowing the lowest of the toy cars in the chamber housing to be launched when the trigger is pulled. The user may then retract the pull lever to cause the chamber housing to rotate 45° to bring an adjacent chamber in line with the ramp. To launch a toy car again, the user must place the support housing on a surface and pull the trigger.

It is noted that throughout this detailed description, words such as "front" and "rear," "forward" and "rearward," "top" and "bottom," and "upper" and "lower," as well as similar positional or locational terms, refer to portions or elements of the toy apparatus as they are viewed in the drawings relative to other portions, or in relationship to the positions of the apparatus as it will typically be held and moved during play by a user, or to movements of elements based on the configurations illustrated.

The present invention also includes a method 750, FIG. 41, for making a toy launcher apparatus, the steps of the method including forming a housing 752 having an opening for storing a properly configured toy to be launched, mounting an ejector to the housing 754, the ejector being movable from a relaxed position to a cocked position by an inserted properly configured toy, mounting an extendible element to the housing and to the ejector 756, mounting a flex member to the housing 758 to prevent the ejector moving from the relaxed position to the cocked position, to deflect in response to engagement with the properly configured toy, and to deflect in response to engagement with the ejector when the ejector is moving from the cocked position to the relaxed position by the extendible element, mounting a trigger mechanism to the housing 760 for releasing the ejector from the cocked position, and mounting a safety lock to the housing 762 for preventing operation of the trigger mechanism when the launcher apparatus is not disposed on a surface.

The toy launcher apparatus disclosed in detail above have great play value, are fun to use and easy to operate, and are safe, even for young children, and yet the toy launcher apparatus are robust, have relatively simple structures, and they may be produced at reasonable cost.

From the foregoing, it can be seen that there has been provided features for an improved toy apparatus and a disclosure of a method for making the toy launcher apparatus. While particular embodiments and variations of the present invention have been shown and described in great detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims as mandated by the United States Code, Title 35, Section 112, when viewed in their proper perspective based on the prior art.

What is claimed is:

1. A toy launcher apparatus comprising:

a housing for storing a properly configured toy to be launched;

an ejector mounted to the housing, the ejector being movable from a relaxed position to a cocked position by insertion of the toy to be launched into the housing and against the ejector, and the ejector being movable from the cocked position to the relaxed position in response to a launch of the inserted toy;

an extendible element mounted to the housing and to the ejector for providing energy to the ejector to launch the toy;

a flex member mounted to the housing, the flex member including a blocking protrusion portion to prevent the ejector from moving from the relaxed position to the cocked position and a protrusion to contact the properly configured toy to cause the flex member to deflect and move the blocking protrusion portion out of the path of the ejector when moving from the relaxed position to the cocked position, and the flex member having a sloping surface to enable the ejector to deflect the flex member when moving from the cocked position to the relaxed position; and a trigger mechanism mounted to the housing to enable the extendible element to transfer launch energy to the ejector.

2. The apparatus as claimed in claim 1, including:

a safety lock mounted to the housing for preventing operation of the trigger mechanism when the apparatus is not disposed on a surface.

3. The apparatus as claimed in claim 2, including:

an upper base mounted to the housing where the toy is stored; and a lower base mounted to the housing where the toy is stored, wherein the flex member is mounted to either the upper base or the lower base.

4. The apparatus as claimed in claim 3, wherein:

the protrusion of the flex member extends into the path of insertion of the toy and is mounted through a slot either in the upper base or the lower base; and the blocking protrusion portion of the flex member extends into the path of movement of the ejector when the ejector is moving from the relaxed position to the cocked position and is mounted through a slot either in the upper base or the lower base.

5. The apparatus as claimed in claim 4, wherein:

the housing is rotatable and enabled to store multiple toys to be launched.

6. A method for making a toy launcher apparatus comprising the steps of:

forming a housing having an opening for storing a properly configured toy to be launched;

mounting an ejector to the housing, the ejector being movable from a relaxed position to a cocked position by an inserted properly configured toy;

mounting an extendible element to the housing and to the ejector;

mounting a flex member to the housing to prevent the ejector moving from the relaxed position to the cocked position until the flex member is deflected in response to engagement with a properly configured toy, and to deflect in response to engagement with the ejector when the ejector is moving from the cocked position to the relaxed position by the extendible element;

mounting a trigger mechanism to the housing for releasing the ejector from the cocked position; and mounting a safety lock to the housing for preventing operation of the trigger mechanism when the launcher apparatus is not disposed on a surface.

7. The method as claimed in claim 6, wherein:

the flex member is mounted to extend into the path of movement of the ejector when the ejector moves from the relaxed position to the cocked position; and the flex member includes a protrusion engageable by a properly configured insertible toy to deflect the flex member out of the path of movement of the ejector when the ejector moves from the relaxed position to the cocked position.

8. The method as claimed in claim 7, wherein:

the flex member is mounted to extend into the path of movement of the ejector when the ejector moves from the cocked position to the relaxed position.

9. The method as claimed in claim 8, including:

forming the housing having multiple openings for storing multiple toys to be launched.

* * * * *